US005431346A

United States Patent [19]

Sinaisky

[11] Patent Number: 5,431,346

[45] Date of Patent: Jul. 11, 1995

[54] NOZZLE INCLUDING A VENTURI TUBE CREATING EXTERNAL CAVITATION COLLAPSE FOR ATOMIZATION

[76] Inventor: Nickoli Sinaisky, 214 Washington Rd., Rye, N.H. 03870-2442

[21] Appl. No.: 95,072

[22] Filed: Jul. 20, 1993

[51] Int. Cl.[6] ..... B05B 1/00; B05B 7/00

[52] U.S. Cl. ..... 239/399; 239/589; 239/487

[58] Field of Search ..... 239/589, 590, 590.5, 239/497, 487, 488, 398, 399, 403, 433

[56] References Cited

U.S. PATENT DOCUMENTS

| | | | |
|---|---|---|---|
| 4,185,706 | 1/1980 | Baker, III et al. | 239/589 |
| 4,391,339 | 7/1983 | Johnson, Jr. et al. | 239/589 |
| 4,813,611 | 3/1989 | Fontana | 239/590.5 |
| 5,125,582 | 6/1992 | Surjaatmadj et al. | 239/589 |

FOREIGN PATENT DOCUMENTS

| | | | |
|---|---|---|---|
| 819319 | 10/1937 | France . | |
| 10357 | 2/1981 | Japan | 239/589 |
| 657858 | 4/1979 | U.S.S.R. . | |
| 896316 | 1/1982 | U.S.S.R. | 239/487 |
| 1147438 | 3/1985 | U.S.S.R. | 239/487 |
| 1708436 | 1/1992 | U.S.S.R. . | |

OTHER PUBLICATIONS

Hammitt, "*Cavitation and Multi-Phase Flow Phenomena*", McGraw-Hill, Inc., New York, 1980.

*Primary Examiner*—Karen B. Merritt
*Attorney, Agent, or Firm*—Pearson & Pearson

[57] ABSTRACT

A nozzle for atomizing a liquid includes at least one Venturi tube. A Venturi tube defines a liquid flow path and has an entrance cone, an intermediate throat of diameter $d_n$, and an exit cone having a length along the flow path to an exit port of at least about $2d_n$. The exit cone also has an angle of divergence that varies from 0° at the throat to about 6° at the exit port. As liquid with an entrained gas, preferably constituting about $10^{-2}$ to about $10^{-3}$ fractions, passes through the throat in a Venturi tube with a Reynold's number greater than about 2300, the liquid static pressure reduces and the entrained gas forms cavities that grow as the liquid passes through the exit cone. The nozzle is substantially free of any structure that could disturb the flow in the nozzle sufficiently to allow the static pressure on the liquid to rise significantly in the nozzle. When the liquid emerges from the nozzle, the liquid static pressure rises and causes the gas cavities to collapse in a zone of collapse and to produce forces that are sufficient to atomize the liquid and to break atomic, molecular and crystalline bonds in the liquid.

53 Claims, 11 Drawing Sheets

NOZZLE INCLUDING A VENTURI TUBE CREATING EXTERNAL CAVITATION COLLAPSE FOR ATOMIZATION

BACKGROUND OF THE INVENTION

1. Field of the Invention

This invention generally relates to apparatus for dispersing fluids and more specifically to a method and apparatus for atomizing liquids.

2. Description of Related Art

Nozzles are used to atomize fluids, such as liquids, gases and liquid-solid slurries, to improve certain characteristics of the fluid. For example, nozzles for internal combustion engines and jet engines atomize fuel to produce fine fuel particles and improve combustion efficiency. Chemical processes use nozzles to atomize materials, such as water, to improve subsequent chemical reactions, such as aeration. Apparatus providing surface treatment or cleaning, such as high pressure washers, may use atomized water or cleaning solutions to impinge material to be cleaned with some momentum to improve surface washing.

In each of these applications, it is often desirable to reduce droplet size to the smallest possible dimension. For combustion and chemically processing, reducing droplet size maximizes the surface area per mass unit that is available for combustion or other chemical reactions. With surface treatment and cleaning, the reduction in size increases the number of drops that impact the surface under treatment. It is also desirable in many of these applications to maximize flow rates through the nozzle usually by increasing the pressure applied to the liquid at the nozzle input.

A number of diverse nozzle constructions have evolved for atomizing liquids. Garden hose and fire hose nozzles are well known examples. Other nozzles atomize fuel, in liquid or slurry form, to increase combustion efficiency. Whether such nozzles do, in fact, increase combustion efficiency is readily determined by examining decreases in fuel consumption for a given thermal output and the nature and quantity of combustion by-products.

For example, nozzles used in tube furnaces have been fitted with spirally shaped narrowing tips that direct atomized fuel along a spiral flow path. This flow path increases the time required for the fuel to pass through an area of combustion or through a flame zone. Although this leads to more complete combustion, this nozzle also produces large droplets. Unburnt fuel precipitates as a solid combustion product. While this approach provides some improvement, incomplete combustion still occurs due to less than optimal atomization.

In an approach described in USSR Inventor Certificate No. 657,858, a spray-swirl atomizer receives liquid under pressure at a nozzle input in a stream form. The liquid stream passes through a narrowing opening. The nozzle swirls the liquid stream prior to ejection through an exit orifice. This nozzle comprises a casing, a supply pipe and a swirler with half cylinder channels directed at about 25° to the axis of the apparatus. Swirling the liquid produces a centrifuging effect that breaks the liquid into droplets as it emerges from the nozzle. However, this structure tends to concentrate the droplets in a conical volume that is displaced from the axis of the nozzle. Thus the liquid exits the nozzle in an atomized form confined to a conical volume or tongue with a central conical volume along the nozzle axis that is substantially devoid of any fuel. Apparatus in the form of an air delivery system increases the atmospheric pressure acting about the exit of the nozzle in order to effect a transfer of the atomized liquid toward the axis and fill the volume. These nozzles do not produce fine atomization and have been characterized by the formation of back currents that detract from the effectiveness and quality of atomization. Moreover, the nozzle channel dimensions are selected to prevent the existence of conditions that would allow the formation of cavities in the liquid.

Nozzles normally atomize fluids by passing a liquid from a supply passageway through a small diameter passage or orifice at an increased velocity. As higher and higher pressures are applied to the input passageway to increase liquid flow and velocity, the static pressure of the liquid decreases. More specifically, the potential energy represented by the static pressure transfers into increased liquid momentum or kinetic energy. Stated differently, the total potential and kinetic energy of the liquid remains constant as the liquid passes through the nozzle assuming that no external energy is applied to the liquid. If $P_\infty$ represents the static pressure of the liquid (i.e., the potential energy component) and if $g_o$ represents the gravitational acceleration and $V_\infty$ represents the velocity of the liquid that define the kinetic energy component, then Bernoulli's theorem can be written as:

$$P_\infty + \frac{V_\infty^2}{2g_o} = K \tag{1}$$

where K is a constant.

Such liquids often carry dissolved or entrained gases having their own internal or partial pressures. If the velocity of the liquid, $V_\infty$, increases and static pressure, $P_\infty$, decreases, the partial pressure of the entrained gas remains relatively constant. Consequently, the gas molecules tend to expand and produce bubbles or cavities within the liquid. If the liquid velocity and input pressure exceed certain minimums, this cavity production, or nucleation, becomes significant.

As liquid leaves the orifice, its velocity, $V_\infty$, decreases rapidly. Consequently the kinetic energy of the liquid due to momentum decreases and the potential energy of the liquid represented by its static pressure, $P_\infty$, increases. Eventually the liquid static pressure reaches a threshold that prevents further cavity growth and actually acts to compress the cavities and collapse them. This collapse produces high bubble wall velocities, high temperatures and large shock forces.

This collapse occurs inside prior art nozzles. The resulting large shock forces can erode the interior of a nozzle and eventually destroy its effectiveness. This phenomenon of bubble formation and collapse therefore has been a limiting factor in the design of prior art atomizers.

Hammitt, *Cavitation and Multi-Phase Flow Phenomena*, McGraw-Hill, Inc. New York 1980, discusses this phenomenon in detail. In one specific example, Hammitt discloses a Venturi tube with an entrance cone that converges to a constant diameter throat of diameter $d_n$ and an exit cone or diffusion section. The exit cone defines a right conical surface that expands along a straight line at a constant angle with respect to the axis through the Venturi tube. When this nozzle operates under conditions that would allow cavitation, erosion can be observed at several locations within the conical diffusion section. In one particular example, metal erosion occurs in the exit cone at $3d_n$, $6.5d_n$ and $10d_n$ downstream from the throat-conical diffusion section interface.

This prior art understanding of cavitation led to a nozzle design philosophy under which nozzle input pressure and liquid velocity are increased to a point just below which significant cavity nucleation begins. Stated differently, these prior art designs avoid or minimize the forces produced by cavity collapse by preventing cavitation or limiting cavitation to insignificant levels. The prior art has never suggested any positive purpose or use for these forces other than as part of flow rate measurement or flow limiting techniques and apparatus.

Other prior efforts have been directed to methods of activating cavitation in liquids for various purposes. For example, U.S.S.R. Inventor Certificate No. 1,227,000 (1984) describes the application of ultrasonic energy to liquids in capillaries of 0.02 to 5.0 mm diameter in order to increase the gas content of a liquid. One outcome of this effort was to determine that a gas concentration of 1.5% was critical to the formation of cavities in a liquid. None of this work, however, was directed to controlling cavity collapse. The application of ultrasonic energy to the liquid apparently only assisted in the mixing of the gas and the liquid. Consequently this effort was directed to increasing the density of gas bubbles or cavities in the liquid. However, nothing was suggested with respect to controlling cavity collapse.

It has also been suggested to excite cavitation by swirling a liquid stream about an axis with subsequent convergence of the stream and ejection of the converged stream through an exit orifice Kerimov et al., "Increase in the Efficiency of Burning Residual Fuel Oil by Using Ultrasonic Atomizers", *For Technical Progress*, No. 8, Page 25 (1978). This disclosure anticipates that cavities will form, expand and collapse thereby to produce ultrasonic waves that will atomize the liquid. In practice this process yields only a low level or intensity of cavitation. Moreover, the cavity collapse, albeit at low levels, occurs within the nozzle. Thus, even if the intensity of the cavity collapse were to increase to useful or practical levels, the collapse would still occur within the nozzle and erode it.

My U.S.S.R. Inventor Certificate No. 1,708,436 describes a nozzle that attempts to harness the forces produced by cavity collapse by forestalling the development of these forces until the cavities exit the nozzle. Like the previously mentioned prior art, liquid with an entrained gas passes through a swirler. Unlike the prior art, a low molecular gas or vapor, typically steam, is added to the liquid in an amount not less than $10^{-3}$ to $10^{-2}$ fractions of the total mass. The steam mixes upstream of a swirler at a distance not less than 10 times the diameter of the exit orifice of the atomizer. As the stream with the introduced gas or vapors swirls along a spiral, convergent path about the nozzle axis, the added gas or vapor particles shift toward the nozzle axis. That is, the steam cavities or bubbles essentially centrifuge and move to the center. This permits the gas concentration along the nozzle axis to increase. These gas particles become cavitation centers and continue to be produced until the static pressure component in the surrounding liquid stream reaches the pressure of saturation of the liquid vapors. A finite time occurs between the emergence of the liquid from the swirlers and the time the cavities collapse for a given rise in static liquid pressure. Controlling the velocity can localize the zone of cavitation and enable each of the cavities or bubbles to store energy in the order of 50 kcal/kg. However, if the pressure is allowed to increase inside the nozzle, cavity collapse can occur inside the nozzle and disrupt the flow from the swirlers thereby causing additional collapse within the nozzle and result in nozzle erosion.

Nozzles constructed in accordance with these later approaches have shifted the zone of cavity collapse to a site outside the nozzle. However, the effectiveness of this control has been dependent upon the velocity of the stream or the ability to operate the nozzle without having the internal pressures of the environment surrounding the nozzle or the static pressure of the liquid rise to a level that would induce cavity collapse. The collapse and attendant energy release have produced droplet sizes in the order of 50 $\mu$m. Yet the full useful potential of cavity collapse has not been fully realized in any of these prior art nozzles. Nozzles continue to produce droplet sizes of larger than optimal size particularly as evidenced by the production of undesirable combustion by-products when fuel oil is burned.

SUMMARY

Therefore it is an object of this invention to provide a nozzle that atomizes liquids to a degree not attained by prior art nozzles.

Another object of this invention is to provide a nozzle that atomizes a liquid into micron and sub-micron dimensions.

Still another object of this invention is to provide a nozzle that provides finer atomization of a liquid without the introduction of any significant additional energy.

Yet another object of this invention is to provide a nozzle that uses cavitation phenomena, particularly the collapse of gas cavities within a liquid, to atomize a liquid passing through the nozzle without any detrimental impact on the nozzle itself.

Still yet another object of this invention is to provide a nozzle for atomizing a liquid utilizing the cavitation phenomena which creates a zone of cavity collapse outside and downstream of the nozzle.

Yet still another object of this invention is to provide a nozzle for atomizing a liquid utilizing cavitation phenomena and collapse of cavities outside and downstream of the nozzle to produce a useful force outside the nozzle.

In accordance with this invention liquid flows through a Venturi tube with an entrance cone, a throat and an exit cone. The throat has a reduced aperture for accelerating the liquid and reducing its static pressure thereby to enable the formation of cavity nuclei. The exit cone constrains liquid flow from the throat such that the static pressure rise between the throat and an exit port lies below a threshold that would otherwise produce cavity collapse. Consequently, the cavities continue to grow as they travel through the exit cone and do not collapse until they are downstream of and exterior to the nozzle.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1A:
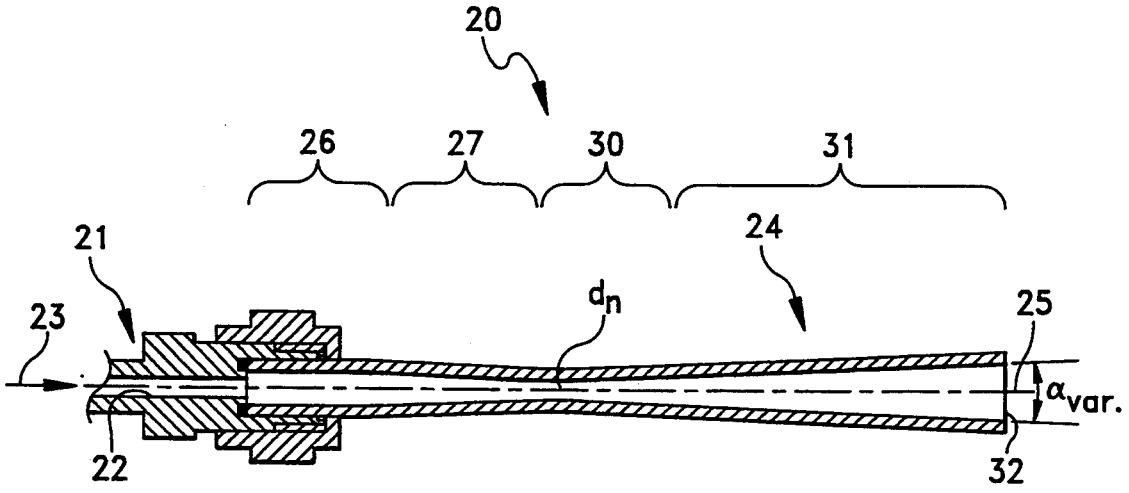
FIGS. 1A, 1B and 1C are drawings of one embodiment and two variants of a nozzle constructed in accordance with this invention.

In the embodiment of FIG. 1A a nozzle 20 constructed in accordance with this invention attaches to a feed pipe 21 including a liquid supply passage 22 for conveying liquid from a supply (not shown, but well known in the art) along a flow path in a direction indicated by an arrow 23 through a Venturi tube 24 lying along a central nozzle or flow axis 25 and having a substantially constant wall thickness. The nozzle axis 25 may lie along a horizontal straight path in FIG. 1 or along a curved path coincidental with a curved axis, such as either of axes 25A or 25B in FIGS. 1B and 1C.

The Venturi tube 24 includes a receiving section 26 that connects to the feed pipe 21. As the liquid moves downstream in the nozzle 20 (i.e., to the right in FIG. 1) the liquid enters a converging entrance cone 27 that tapers to a cylindrical throat 30 having a diameter "$d_n$". A diverging exit cone 31 extends downstream from the throat 30 for some distance to an exit port 32.

In basic terms, the liquid supply provides the liquid with an entrained or dissolved gas in a non-atomized form under conditions that induce cavitation to begin as the liquid passes into the throat 30. The process by which the cavities begin to form is called cavity nucleation and begins when the static pressure of the liquid decreases as potential energy transfers into increased kinetic energy with the increased velocity of the liquid through the throat 30 in accordance with Eq. (1). When the static pressure of the liquid reduces sufficiently, the partial pressure of the entrained gas acts to expand the gas within the liquid thereby forming cavities within the liquid.

The exit cone 31 prevents the static pressure of the liquid from rising significantly until after the liquid leaves the Venturi tube 24 at the exit port 32. Stated differently, the static pressure in the exit cone 31 does not reach a level that will initiate gas cavity collapse. After the gas cavities emerge from the nozzle 20 through the exit port 32, any number of conditions, including reduced liquid velocity and external pressure exerted by the environment surrounding the emerging liquid, increase the static pressure on the liquid to the value that produces cavity collapse.

As known, cavity collapse produces with its attendant high wall velocities and temperatures yields a significant energy release. The nozzle 20 of FIG. 1 locates this cavity collapse and energy release downstream and exteriorly of the nozzle. Consequently the energy release acts upon the liquid and finely atomizes it into micron and sub-micron sizes. In many applications this energy release can break atomic, molecular and crystalline bonds in the liquid. As all this energy release occurs outside the nozzle 20; none of the released energy erodes materials in the nozzle 20.

In order for a Venturi tube 24 to operate with the foregoing properties, the liquid passing through the nozzle 20 and the construction of each section within the nozzle 20 must meet certain criteria. First, the liquid must contain a dissolved or mixed gas that provides optimal gas concentration in the throat 30 of about 1.5% by volume. The entrained gas may appear as a natural constituent or, as described later, be added to the liquid upstream of the nozzle 20.

Secondly, the supply must deliver this gas and liquid at a velocity that is greater than a predetermined Reynold's number. Reynold's numbers define the nature of liquid flow through a passage. As liquid flow increases to define a Reynold's number greater than 3000, the flow becomes progressively more turbulent. Conversely, as the flow decreases to define a Reynold's numbers below 3000, the flow becomes progressively more laminar. The Reynold's number, $R_o$, for a tubular passage is given by:

$$R_e = \frac{WD}{A\mu g_o} = \frac{VD}{\nu} \quad (2)$$

where "W" is the liquid mass flow rate; "D" is the diameter of the passage through the tube; "A" is the flow area; $\nu$ is the kinematic viscosity of the liquid; "$g_o$" is the gravitational constant; "V" is the velocity of the liquid in the passage; and $\mu$ is the absolute viscosity of the liquid given by:

$$\nu = \mu/\rho \quad (3)$$

where $\rho$ is the mean density of the liquid.

Cavitation only occurs when the flow is characterized by a Reynold's number greater than 2300. If the Reynold's number decreases below 2300, the velocity increase through the throat 30 does not reduce the liquid static pressure sufficiently to enable significant cavity nucleation. Consequently the nozzle 20 should operate with a Reynold's number greater than that minimum; that is:

$$R_e > 2300 \tag{4}$$

Figure 1B:
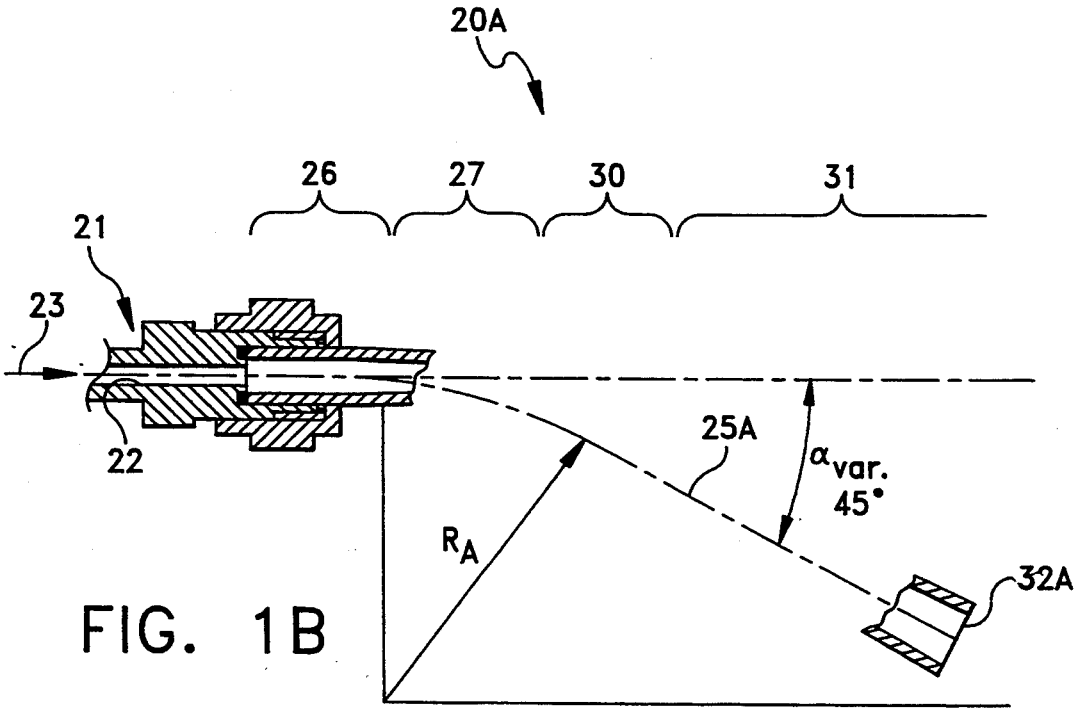
Figure 1C:
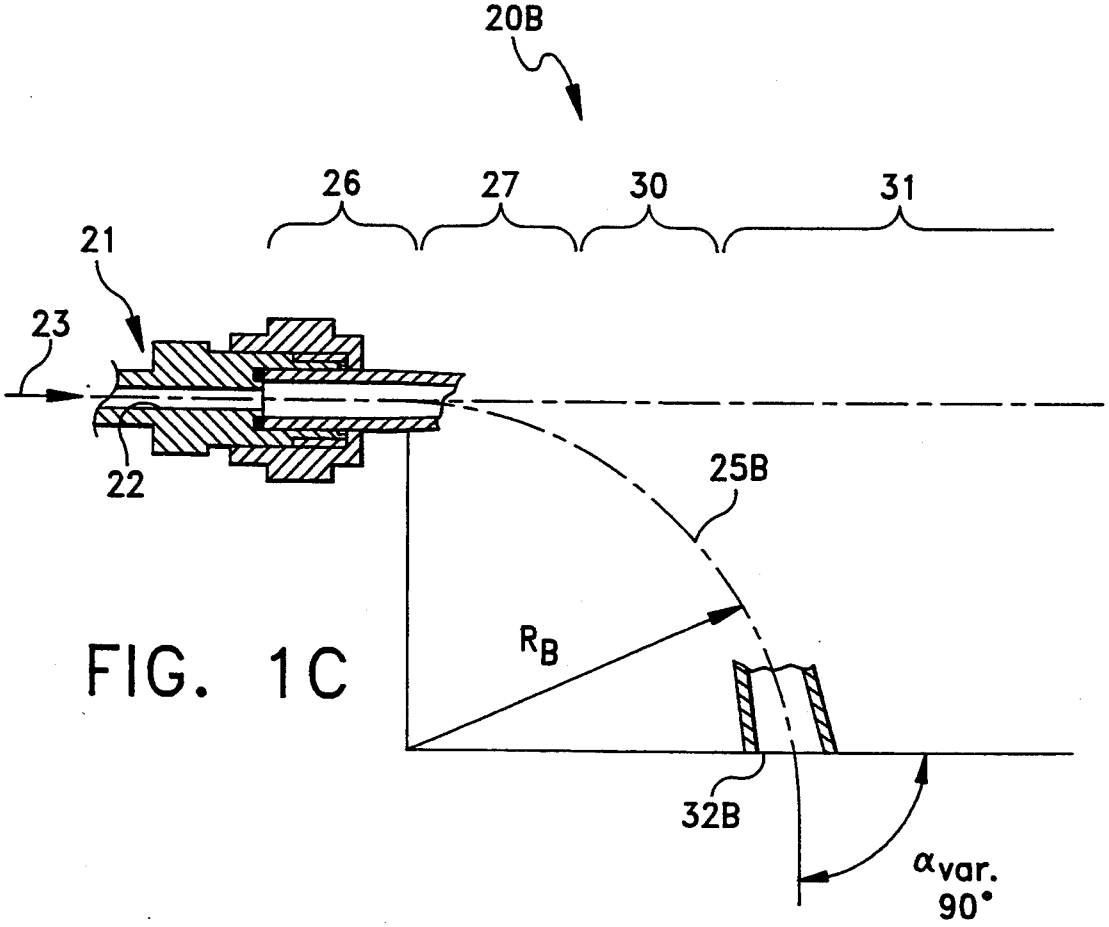

Liquid must flow through the nozzle without the introduction of any localized disturbances due to the surface irregularities, particularly in the entrance cone 27, the throat 30 and the exit cone 31, or the configuration of the Venturi tube. Any localized disturbance allows the static pressure acting on the liquid in the disturbance to rise and initiate cavity collapse within the nozzle 20. If surface irregularities are less than 1 micrometer, and preferably less than 0.63 micrometers, liquid flow over the nozzle surfaces will not produce a localized disturbance. FIGS. 1B and 1C depict two variants of the nozzle 20 in which the Venturi tube 24 arcs in a plane along the curved axes 25A and 25B respectively. The axis 25A has a radius $R_A$ and exit port 32A that establishes a flow path displaced 45° with respect to the axis 25. As another variant, the curved axis 25B having a radius $R_B$ establishes a flow path displaced 90° from the axis 25. Whenever the nozzle 20 arcs in a plane, the radii should be selected to allow the flow through the exit cone to continue to be within the range established by Eq. (4). Methods for establishing a radius for particular flow characteristics are well known in the art and the constant wall thickness of the Venturi tube 24 facilitates bending by these methods. When these conditions are met, the Venturi tube 24 will not, by virtue of its deflecting the flow path from a straight line axis 25, produce any significant localized disturbance in the liquid.

Figure 2:
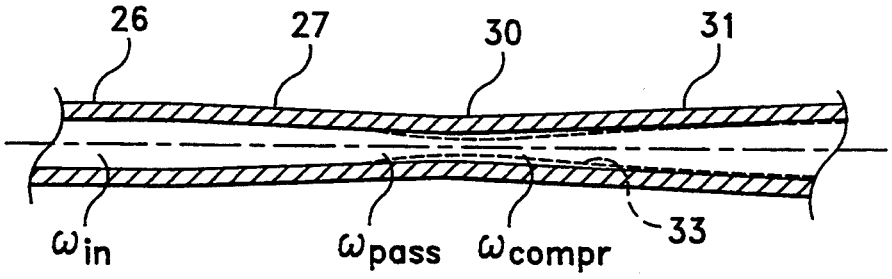
FIG. 2 is an enlarged detail view of a portion of the nozzle shown in FIG. 1A.

The nozzle 20 also must meet certain design criteria. The throat 30 must have a diameter that is selected, along with other dimensions, to induce cavity nucleation. FIG. 2 depicts the detail of a portion of the supply 26, the converging cone section 27, the throat 30 and a portion of the diverging exit cone 31. The receiving pipe 26 has a cross-sectional area of $\omega_{in}$. The converging entrance cone 27 reduces that area to the area through the throat designated as $w_{pass}$. As the liquid flows through the converging entrance cone 27 into the throat 30, its momentum entering the throat section 30 tends to further compress the liquid into a free stream flow having a boundary represented by dashed line 33 that, at its narrowest point, produces a free stream cross-section of $\omega_{compr}$.

The relationship of the cross-sectional areas of the receiving pipe 26 and throat 30 defines a critical cavitation constant, $K_{crit}$, that sets an upper limit or boundary for the operating parameters. More specifically:

$$K_{crit} = \left( \frac{\omega_{in}^2}{\omega_{pass}^2 \left( 0.611 + 0.148 \frac{\omega_{pass}^2}{\omega_{in}^2} \right)^2} - 1 \right) + \tau \tag{5}$$

where $\tau$ is a coefficient of local drag or flow resistance and $\tau \leqq 0.2$; and where $K_{crit} \leqq 0.95$. For these particular values, a constriction coefficient is given by:

$$0.8 \leqq \frac{\omega_{pass}}{\omega_{in}} \leqq 1. \tag{6}$$

Operating criteria can be given in terms of a cavitation number, $K_{ser}$. For practical effective operation of a nozzle 20 as shown in FIG. 1, $$K_{ser} \leqq K_{crit} \tag{7}$$

and, more specifically, $$0.02 \leqq K_{ser} \leqq 0.75. \tag{8}$$

This cavitation number can also be defined as $$K_{ser} = \frac{2(P_\infty - P_v)}{\rho V_{compr}^2} = \frac{V_{compr}^2}{V_{in}^2} - 1. \tag{9}$$

Using the minimum Reynold's number, the input velocity can be given by $$\frac{V_{in}^{min} D_{in}}{\nu} > 2300. \tag{10}$$

Another design criteria involves the divergence of the exit cone 31. The exit cone 31 must prevent the static pressure of the liquid from rising above a threshold at which the static pressure can stop cavity growth and initiate cavity collapse. Either a decrease in liquid velocity with a resultant decrease in kinetic energy and increase in potential energy or the application of pressure from some external source can cause liquid static pressure to increase. Constructing the exit cone with minimal surface irregularities eliminates one cause of localized disturbances, as previously discussed.

The inner surface of the diverging exit cone 31 should conform to a hyperbolic cone in which the angle of divergence increases as the distance to these positions from the throat 30 increases. In a preferred embodiment the divergence angle increases from 0° at the throat 30 to an included angle of 6° at the port 32. For long exit cones 31 the variable angle may increase to reach 6° at some intermediate distance, such as $8d_n$, from the throat 30 and then remain at a constant 6° to the exit port 32. Still other configurations are possible. If the exit cone 31 bends as shown by exit port 32A and 32B in FIGS. 1B and 1C, respectively the maximum angle may be greater than 6° and the included angle may be non-symmetrical with respect to the axis 25A or axis 25B. An exit cone 31 constructed in accordance with the foregoing criteria does not impede liquid flow so the liquid velocity does not decrease significantly in the exit cone 31. This prevents any significant increase in potential energy within the exit cone 31. Moreover, any change in the direction of fluid flow, as to the exit ports 32A or 32B, occurs without producing a localized disturbance and a collapse inside the nozzle 20.

The exit cone 31 also prevents any pressure from an external source from acting directly on the liquid. With a straight Venturi nozzle as shown in FIG. 1A, exit cone lengths of $3d_n$ to $20d_n$ have found to provide a practical range of the exit cone lengths. Exit cones lengths of greater than $3d_n$ provide sufficient constraints for the free stream flow to allow the flow to continue appropriately. Although nozzles having exit cones longer than $20d_n$ can be constructed, as a practical matter exit cone lengths of $20d_n$ or less will suffice in most applications.

Figure 3:
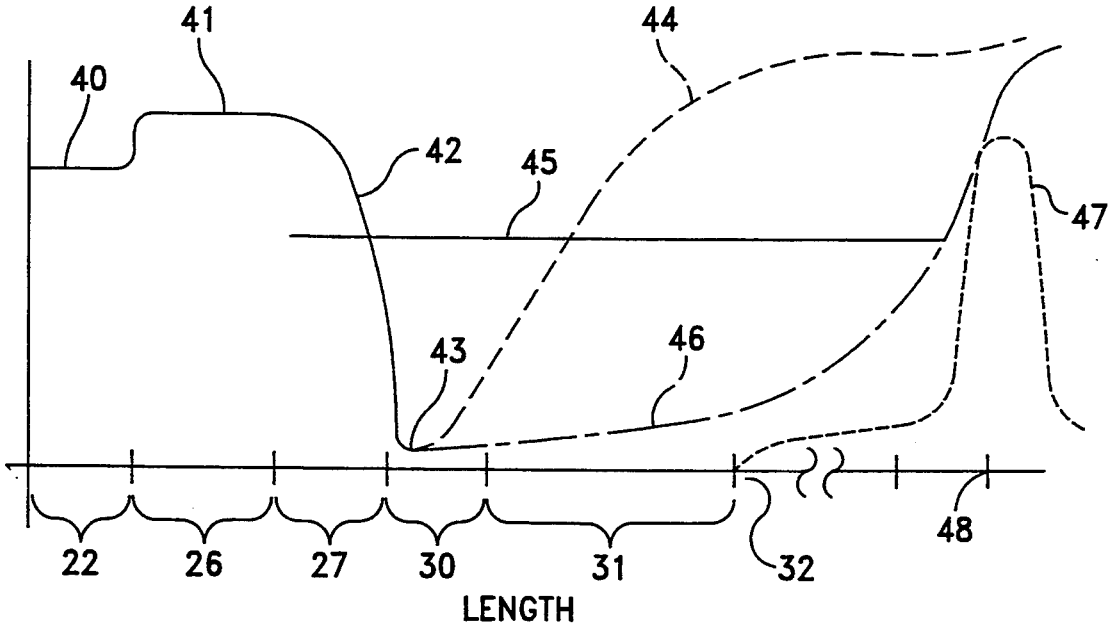
FIG. 3 is a diagram depicting parameters during the operation of the nozzle of FIG. 1A.

FIG. 3 depicts variations in static pressure $P_\infty$, as the liquid passes from the passage 22 through the nozzle 20 in FIG. 1. Curved segment 40 corresponds to the static pressure in the passage 22. This pressure rises to a level corresponding to curve 41 as the liquid enters the receiving section 26 with its greater diameter and travels to the converging entrance cone 27. As the liquid passes through the converging entrance cone 27 into the throat 30, the pressure drops as shown by segment 42 to a minimum static pressure 43. This corresponds to the point of maximum liquid velocity along the axis 25 in FIG. 1.

If the nozzle 20 were to terminate at the downstream end of the throat 30 without appropriate safeguards with respect to static pressure rise, the static pressure would immediately rise as shown by dashed line 44 and eventually increase over a threshold static pressure represented by horizontal line 45. Static pressure above this static pressure threshold 45 initiates cavity collapse. In the prior art that collapse occurs within the nozzle, so all the forces produced by the collapse of cavities occur within the nozzle.

With an exit cone 31 constructed in accordance with this invention, the static pressure remains below the threshold static pressure 45. Curve 46 represents the static pressure in the exit cone 31. When the liquid leaves the nozzle 20, the static pressure rises and eventually exceeds the threshold 45 to trigger an energy release as shown by curve 47. The distance between the output end of the nozzle 32 and a point 48 at which the energy release represented by the dashed line 47 varies depending upon the velocity of the liquid leaving the exit and the pressure in the surrounding environment acting on that liquid.

Liquid can leave the exit port 32 in a turbulent flow, as separate droplets or as both. However, the energy released during cavity collapse can be in the order of 400 watts per square meter that is significantly greater than 0.1 watt per square meter released in my prior nozzle structures as disclosed in U.S.S.R. Inventor Certificate No. 1,708,436. This energy release appears as a shock force and further divides the liquid, in some cases by separating atomic, molecular or crystalline bonds, to reduce the size of any droplets to a size that is not readily measured. Observations indicate that the size is significantly less than 50 microns. In some applications the energy release and shock forces will be used solely for atomizing the liquid from the exit port 32. In other applications, such as cleaning applications using pressure washers, the nozzle can be positioned to locate the shock forces at a surface to break up any surface materials prior to removal.

FIG. 1A discloses a nozzle 20 with a single Venturi tube 24. It will be apparent that the nozzle 20 will have a limited flow rate. Greater flow rates can be achieved by constructing a nozzle with multiple Venturi tubes that may lie on either parallel axes or converging axes. Such nozzles may also include Venturi tubes that provide both straight and curved flows adjusted to converge the liquid leaving the nozzle. The same design and construction criteria underlying the Venturi tube 24 of FIG. 1A would apply to a nozzle incorporates multiple Venturi tubes.

As known liquid flows through the nozzle 20 in FIG. 1A at different velocities along and parallel to the axis 25. These velocities area at a maximum along the axis 25 and at essentially zero or minimum velocity at the surface of the nozzle 20. Static pressure is therefore at a minimum value along the nozzle axis 25. Both the distribution of the cavities and the rate of growth tend to follow the velocity distribution.

Figure 4:
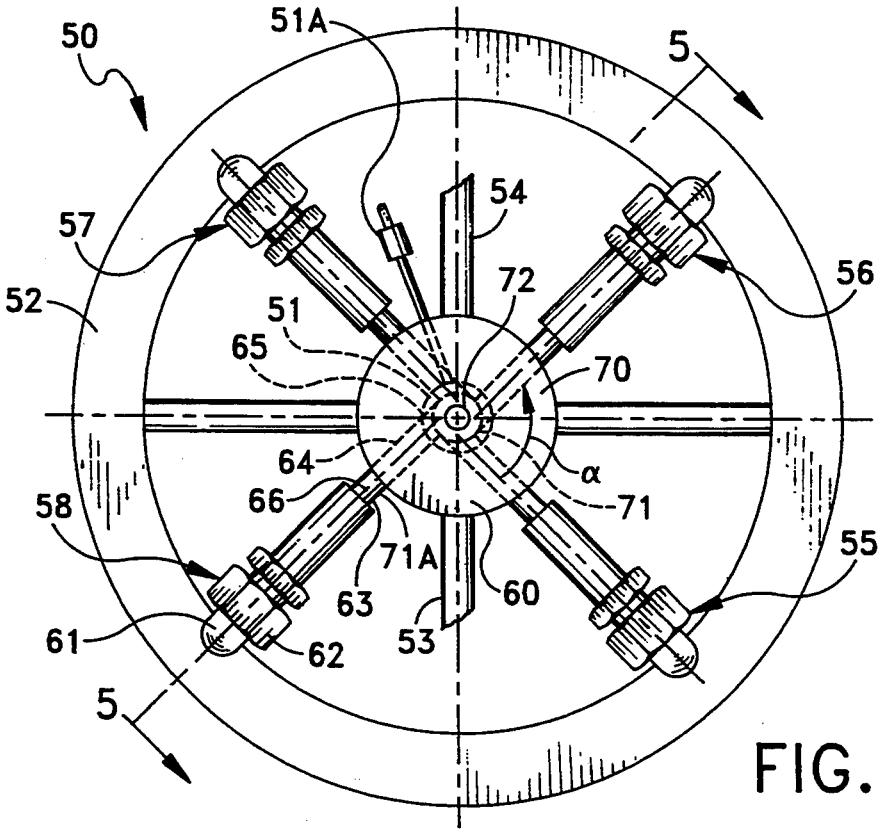
FIG. 4 is a plan view of a second embodiment of a nozzle constructed in accordance with this invention.
Figure 5:
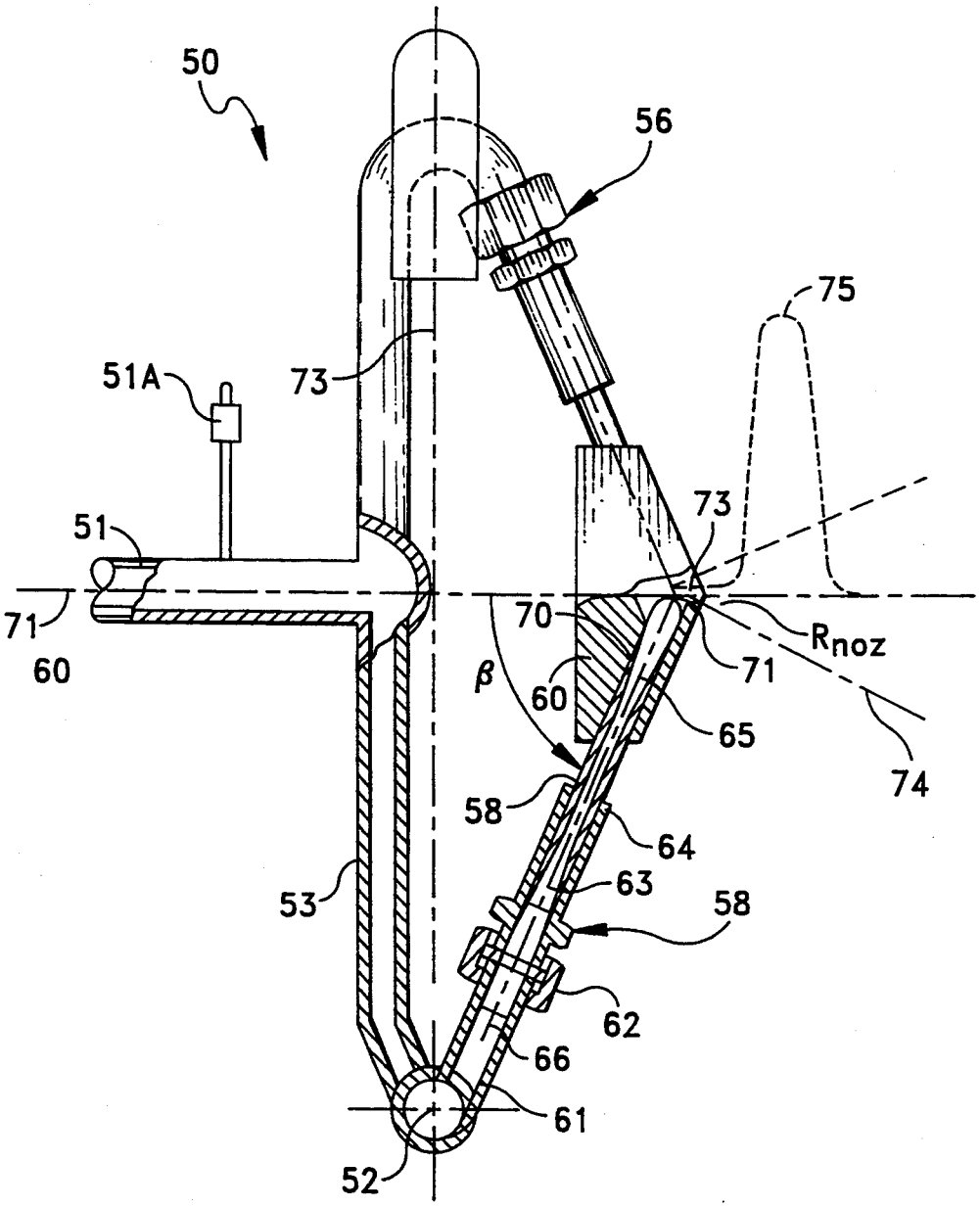
FIG. 5 is a section taken along lines 5—5 in FIG. 4.

FIGS. 4 and 5 disclose another nozzle 50 that is particularly adapted for low-temperature processing such as oil dewatering, fat deodorizing, petroleum distillation, tar sands refining and paper reprocessing. The nozzle 50 swirls the liquid with the entrained growing cavities to provide a more homogenous cavity dispersion in the liquid. The nozzle 50 utilizes a plurality of Venturi tubes analogous to the Venturi tube 24 shown in FIG. 1A. The Venturi tubes are spaced substantially equiangularly for emitting multiple streams into a vortex chamber. The vortex chamber mixes the liquids before the stream emerges from the nozzle 50. A supply pipe 51 delivers liquid with the dissolved or entrained gas to the nozzle 50. An optional injector 51A may be included to add gas or steam to the liquid if the entrained gas concentration is less than an optimal level. The liquid and entrained gas flow from the supply pipe 51 to an annular manifold 52 through one or more radial supply pipes, such as radial supply pipes 53 and 54.

In this particular embodiment the nozzle 50 comprises a plurality of four Venturi tubes 55, 56, 57 and 58 that extend between the manifold 52 and a vortex assembly 60 to provide four separate parallel flow paths to the vortex assembly 60. Each of the Venturi tubes 55 through 58 has a structure that is analogous to the Venturi tube 24 in FIG. 1A. Using the Venturi tube 58 as an example and referring to FIG. 5, a liquid supply 61 interconnects the manifold 52 and a fitting 62 for directing the liquid into an entrance cone 63, a throat 64 and an exit cone 65 along a Venturi tube axis 66.

The vortex assembly 60 includes a body 70 that is centered on a nozzle axis 71 (a horizontal axis in FIGS. 4 and 5) through the supply pipe 51. The vortex body 70 receives each of the Venturi tubes 55 through 58 in a centrally located vortex chamber 72 that communicates with an exit orifice 73. In this particular embodiment, each of the Venturi tubes 55 through 58 directs liquid from the respective exit cones, such as exit cone 65, into the vortex chamber 72 along a flow path that is essentially tangential to the vortex chamber 72. Referring to FIG. 4, the intersection between one Venturi tube axis, such as the axis 66, and a line between two adjacent Venturi tubes, such as Venturi tubes 55 and 57, is essentially 90°. However, each of the Venturi tubes may be skewed in the plane of FIG. 4 and with respect to the vortex chamber to provide an angle "$\alpha$" in the range from 10° to 90° (i.e., $10° \leqq \alpha \leqq 90°$).

Referring to FIG. 5, each of the Venturi tubes 55 through 58 cants from a vertical plane. If $\beta$ represents the angle between the nozzle axis 71 and a Venturi tube axis such as the axis 66, the angle $\beta$ can vary between 10° and 90° (i.e., $10° < \beta < 90°$). As the liquid moves along the canted axis 66, it gains momentum or velocity component along the axis 71 that carries the swirled jet formed in the vortex chamber 72 out the exit orifice 73.

Liquid entering each of the Venturi tubes 55 through 58 from the supply pipe 51 and manifold 52 accelerates through the corresponding throats, such as the throat 64, to initiate cavity nucleation in the same manner as is discussed with respect to FIG. 1A. As the individual fluid streams emerge from the Venturi tubes 55 through 58 and circulate in the vortex chamber 72, the cavities continue to grow because the static pressure within the vortex remains at a low level. Moreover the cavity nuclei disperse through the liquid with greater homogeneity. The vortex chamber 72 allows the liquid to continue to move at a significant velocity and the liquid emerging from the exit orifice 73 prevents any external pressures from acting on the liquid inside the vortex chamber 72.

Still referring to FIG. 4, the axis 66 through the Venturi tube 58 is displaced from a parallel axis 71A through the nozzle axis 71. The displacement between the axes 66 and 71A represents a twisting arm radius $R_y$. In FIG. 5 the exit orifice 73 has a radius $R_{noz}$. When a twisting arm exists for swirling the liquid, it has been found that the following relationship will prevent the formation of a localized disturbance:

$$\frac{R_y}{R_{noz}} \geqq 1. \tag{11}$$

When these criteria are met the liquid emerges from the exit orifice 73 in a conical film 74 that is characteristic of swirling liquids emerging from an orifice. When, as previously described, the static pressure of the liquid rises, the cavities will collapse with a resultant energy release as shown by dashed lines 75 in FIG. 5. This energy release in this embodiment of FIGS. 4 and 5 is dispersed through the film with a more even distribution than provided by the Venturi tube 24 in FIG. 1A. This release occurs downstream and externally of the nozzle 50 including the vortex chamber 72 and atomizes the liquid in the film into the micron and submicron particles and can be in the order of 300 to 400 watts per square meter.

Figure 6:
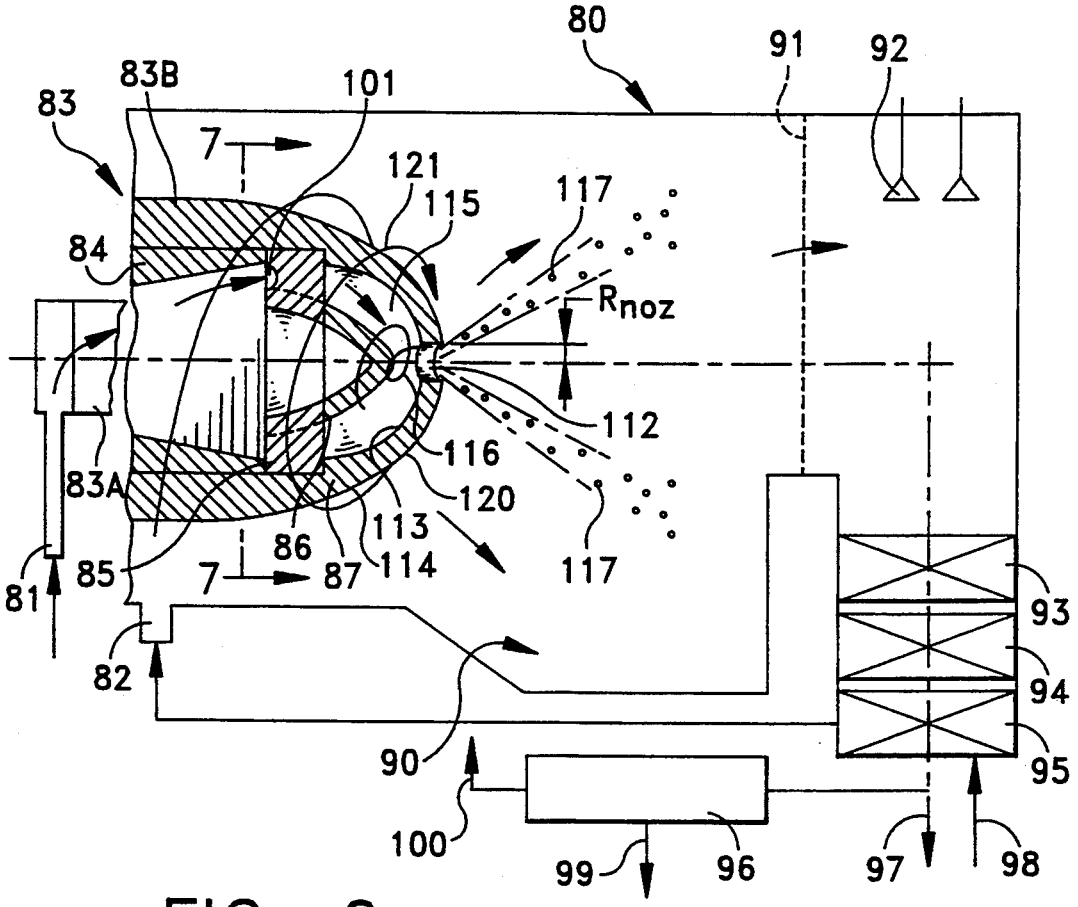
FIG. 6 is a schematic diagram of a third embodiment of a nozzle constructed in accordance with this invention for use in a combustion chamber with heat precipitating surfaces.
Figure 7:
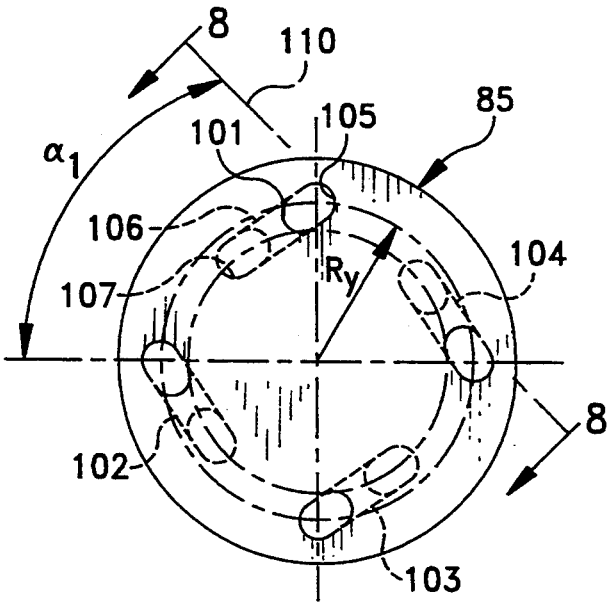
FIG. 7 is a section taken along lines 7—7 in FIG. 6.
Figure 8:
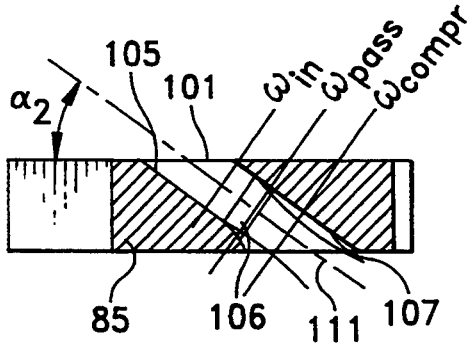
FIG. 8 is a section taken along lines 8—8 in FIG. 7.

FIGS. 6 through 8 disclose another embodiment of a nozzle that improves liquid atomization and that is adapted for use in improving fuel combustion in furnaces, internal combustion engines and other devices. Furnaces include those used in power plants and steam generating plants that use liquid fuels, fuel-oil water emulsions or solid fuels, such as coal, suspended in a liquid. The furnace may operate under vacuum or low counter pressure. Internal combustion engines include engines for ground, sea and air transport apparatus. These engines may be piston or jet-type internal combustion engines that use heavy fuels, motor fuels, naphtha, kerosene, gasoline, propane, hydrogenated liquid fuel and the like. Other devices include petroleum refining and processing plants such as reclamation apparatus, liquid aeration apparatus, or water delivery systems for agricultural purposes.

As with the previous embodiments, the nozzle shown in FIGS. 6 through 8 intensifies the formation of cavities and controls the transport of the fuel or other liquid through the nozzle so that cavitation collapse occurs outside and downstream from the nozzle. When used with liquids that are compounds or mixtures, such as fuels, the cavitation collapse produces significant forces that increase the yield of gasified molecules and atoms from the atomized liquid. More specifically, the nozzle shown in FIG. 6 enhances the atomization of the fuel oil film in the root of a spray cone exiting from the nozzle so the combustion process is more complete. Consequently there is a better utilization of the heat content of the fuel and a reduction in the dispersed phase of combustion by-products and emissions, particularly nitrous oxides and other toxic emissions. This improves the state of the atmosphere, particularly when the nozzle operates in a combustion chamber with various heat precipitation surfaces.

More specifically, a furnace 80 shown in FIG. 6 includes a fuel delivery pipe 81 and an air supply pipe 82. Fuel from the pipe 81 travels into a cavitating nozzle 83 constructed in accordance with this invention and represented partially as a block 83A and partially as a detailed structure 83B beginning at a diffuser section 84. The downstream end of the diffuser section 84 terminates with a transverse swirler plate 85 that has an external cowling 86 and housing 87 spaced with respect to each other and forming spaced ogive internal surfaces.

Atomized fuel from the nozzle 83 enters a combustion chamber 90 to burn. The products of combustion then leave the furnace by passing over various heat exchanging and precipitating surfaces. FIG. 6 depicts a typical steam generating system for power plants and the like in which the heat and other produces of combustion pass over water-cooled furnace walls 91 that constitute a primary heat exchanger, a washer 92, a superheater 93, an economizer 94, an air heater 95 and a precipitator 96 in a smokestack. The air heater 95 provides heated air to the furnace through the air supply 82. Arrows 97 and 98 represent paths to and from other optional heat exchangers and the like. Arrow 99 represents the removal of materials from the precipitator 99 while arrow 100 represents flue gases exhausted to the atmosphere through the smokestack. This example is for purposes of explanation only; and, as will be apparent, a particular steam generating system may have any of several diverse configurations.

The swirler plate 85, shown in more detail in FIGS. 7 and 8, includes a plurality of Venturi tubes 101 through 104, each of which has a construction represented by the Venturi tube 101 in FIG. 8. Specifically the Venturi tube 101 includes an entrance cone 105, a throat 106 and a diverging exit cone 107 constructed along the same lines as the Venturi tube 24 in FIG. 1A. In this embodiment each of the Venturi tubes 101 through 104 lies along a linear flow path. In each the exit cone length along that linear flow path is greater than $d_n$ and less than about $2d_n$. The resulting Venturi tube has the characteristic receiving cross-sectional area $\omega_{in}$, throat cross-sectional area $\omega_{pass}$ and compressed free stream flow cross-sectional area $\omega_{compr}$. Each of the Venturi tubes 101 through 104 meets the criteria of Equations (5) through (10) to provide an individual liquid stream with dispersed gas cavities that begin to grow within the liquid as each liquid stream passes through an exit cone, such as the exit cone 107.

In accordance with another aspect of the nozzle embodiment shown in FIGS. 6 through 8, each of the Venturi tubes 101 through 104 passes through the swirler plate along skewed linear axes 110 and 111 that angles $\alpha_1$ and $\alpha_2$ define. The angle $\alpha_1$ represents the angle through a Venturi tube, such as Venturi tube 104, in the plane of the swirler plate 85 relative to a line from the center of the swirler plate through the center of the entrance cone. The angle $\alpha_2$ represents the angle through the swirler plate that is bounded by the planar surface of the swirler plate 85 and an axis 111 through the swirler plate 85 for the corresponding Venturi tube, such as Venturi tube 101 in FIG. 8. These two angles define a twisting arm radius $R_y$ and can operate in the ranges:

$$40° \leqq \alpha_1 \leqq 72° \tag{12}$$

and $$15° \leqq \alpha_2 \leqq 60°. \quad (13)$$

As the liquid enters each of the Venturi tubes 101 through 104, the angular offset defined by $\alpha_1$ and $\alpha_2$ introduces tangential and radial liquid momentum or velocity components that divert the liquid from a straight line path along a nozzle axis in the diffuser section to a converging spiral path between the swirler plate 85 and an exit orifice 112 having a radius $R_{noz}$. As discussed with respect to the nozzle in FIGS. 4 and 5, the relationship between the twisting arm and the radius of the exit orifice 112 should satisfy Equation (11).

With this nozzle construction essentially all shift in momentum occurs before the liquid reaches the entrance cone 105 so that the flow path of the liquid through the throat 106 and the exit cone 107 occurs without generating a localized disturbance, even with a small bending radius for the flow path between a Venturi tube and the exit orifice 112. By introducing this momentum change before the entrance cone section 105, the liquid flows from each of the Venturi tubes 101 through 104 through the space between the cowling 86 and housing 87 and emerges from the exit orifice 112 in the housing 87 before the static pressure on the liquid can increase significantly.

In a preferred form, liquid travels about $5d_n$ between the exit cone 107 and the exit orifice 112 along its converging swirling path. Also the total inlet area to the Venturi tubes 101 through 104, $A_{in}$, to the area of the exit orifice 103, $A_{noz}$, is in the range $$1.3 < \frac{A_{in}}{A_{noz}} < 4. \quad (14)$$

In accordance with a preferred form of this nozzle, the cowling 86 and the housing 87 have spaced facing surfaces 113 and 114, respectively, that are formed in a shape approaching an ogive portion with concave and convex sweeps respectively. When the fuel streams emerge from the swirler plate 85 and the Venturi tubes 101 through 104, they travel in a volume 115 along converging spiral paths, such a path 116, until they reach the exit orifice 112.

In this embodiment the volume 115 can fill with liquid. However, the liquid stream emerging from each of the Venturi tubes 101 through 104 will continue to travel along its converging spiral path, such as path 116, until it leaves the exit orifice 112 in a conical film 117. The liquid stream leaving each Venturi tube is therefore submerged in the remaining liquid. So long as the liquid stream exits the nozzle without producing significant eddies or recirculations in the volume 115, the liquid streams emerge without causing a local disturbance in the volume 115. Therefore, the static pressure on the liquid stream remains low. In one embodiment static pressure gradients for the liquid do not exceed $1 \times 10^4$ Pa/cm across the entire nozzle 83. With this gradient, the cavities collapse and release energy in a zone of collapse that is external to and downstream of the nozzle 83.

During the swirling operation in the nozzle 83, the cavities in the liquid streams tend to shift to the center to provide a potential for increased collapse activity. When they collapse, the cumulative effect is sufficient to break atomic, molecular and crystalline bonds in the film by releasing energy ($\phi_{cav}$) of at least two orders of magnitude over the energy released ($\phi_{prior}$) from nozzles as described in my Inventors Certificate No. 1,708,436; i.e.:

$$\frac{\phi_{cav}}{\phi_{prior}} > 100 \quad (15)$$

and over three orders of magnitude greater than the energy released from conventional nozzles ($\phi_{conv}$):

$$\frac{\phi_{cav}}{\phi_{conv}} > 1000. \quad (16)$$

Typically the mean energy release is measured in Watts per square meter (i.e. $W/m^2$). In accordance with this invention, cavity collapse can produce a mean energy release of 400 $W/m^2$. At these energy levels the impact forces produced by the collapse of the bubbles break atomic, molecular and crystalline bonds in the liquid fuels and solid parts of the fuels having bond strengths of up to 200 to 400 kJ/kg as opposed to 50 kJ/kg in prior art nozzles.

Furnaces usually operate with excess air supplied to support combustion (i.e., at a greater than stoichiometric relationship). The nozzle 83 allows the air to be supplied in the range of 1,005 to 1.02 times the stoichiometric amount to increase combustion efficiency and reduce sulfur and nitrogen oxides in the flue gases by two-thirds to one-half. The combustion process is also accompanied by a condensation of reaction products of metals and the formation of particles of colloidal-dispersed dimensions which change the process of ash precipitation and thereby simplify the reclamation of certain metals and the maintenance requirements for the furnace 80.

The ogive nature of the housing, in addition to assuring that the liquid streams pass through the volume 115 without causing a localized disturbance, improves air flow over an exterior surface 120. When air swirls into the furnace 80 around the housing 87 as represented by arrow 121, it passes to the outlet orifice 112 without forming recirculation zones because the concave ogive surface 120 introduces a minimum resistance to air motion. Moreover, when surface irregularities are maintained at a low order (i.e., 2.5 micrometers or less), the size of carbon particles resulting from improper combustion that can deposit on the nozzle are reduced to about 7 micrometers or less. Particles of this size can not deposit on the surface 120. Consequently they slip over the ogive surface 120 into the conical film root 117 that emerges from the exit orifice 112.

The following table provides design, operational and result parameters for assessing the benefits of this invention when applied to a nozzle constructed in accordance with FIG. 6. The design characteristics (Parameter Nos. 1 through 6), operating conditions (Parameter Nos. 7 through 10) and benefits (Parameter Nos. 10 and 11) are shown for two specific power plant installations. The power plant in Example 1 was equipped with nozzles including a swirler plate and cylindrical passages as described in my U.S.S.R. Inventor Certificate No. 1,708,436. The power plant in Example 2 was equipped with nozzles constructed along the lines of the embodiment shown in FIGS. 6 through 8.

| PARAMETER NO. | PARAMETER | EXAMPLE 1 | EXAMPLE 2 |
|---|---|---|---|
| 1 | $A_{in}/A_{noz}$ | 4 | 2.85 |
| 2 | $R_y/R_{noz}$ | 5.28 | 6 |
| 3 | $\alpha_1$ | 72° | 57° |
| 4 | $\alpha_2$ | 45° | 45° |
| 5 | $n = \omega_{pass}/\omega_{in}$ | 1 | 0.89 |
| 6 | $K_{crit}$ | 0.95 | 0.85 |
| 7 | $V_{in}$ | 3.65 m/s | 6.38 m/s |
| 8 | $R_e$ | 2500 | 3500 |
| 9 | $V_{compr}$ | 4.0 m/s | 6.88 m/s |
| 10 | $P_{ser(fuel)}$ | $7 \times 10^5$ Pa | $11 \times 10^5$ Pa |
| 11 | $K_{ser}$ | <0.28 | <0.16 |
| 12 | $\Psi_{cav}/\Psi_{conv}$ | 150 | 2000 |

More specifically it will be apparent from the foregoing table, particularly design parameter Nos. 1 through 6 that the passage diameters (Nos. 1 and 2), swirling passage angles (Nos. 3 and 4) and constriction coefficient (No. 5) lead to a reduction to the central cavitation coefficient (No. 6) of Equation (5). This permits increased flow rates through the nozzle (Nos. 7 and 9) and an increase in the Reynold's number (No. 8). Moreover, the operating pressure can be increased (No. 10) without establishing a non-cavity condition or a cavity condition in which collapse occurs within the nozzle. Consequently the nozzle 83 operates with a lower cavitation number and a dramatic increase in the energy released over conventional atomizers and over the swirling caviators of Example 1.

Figure 9:
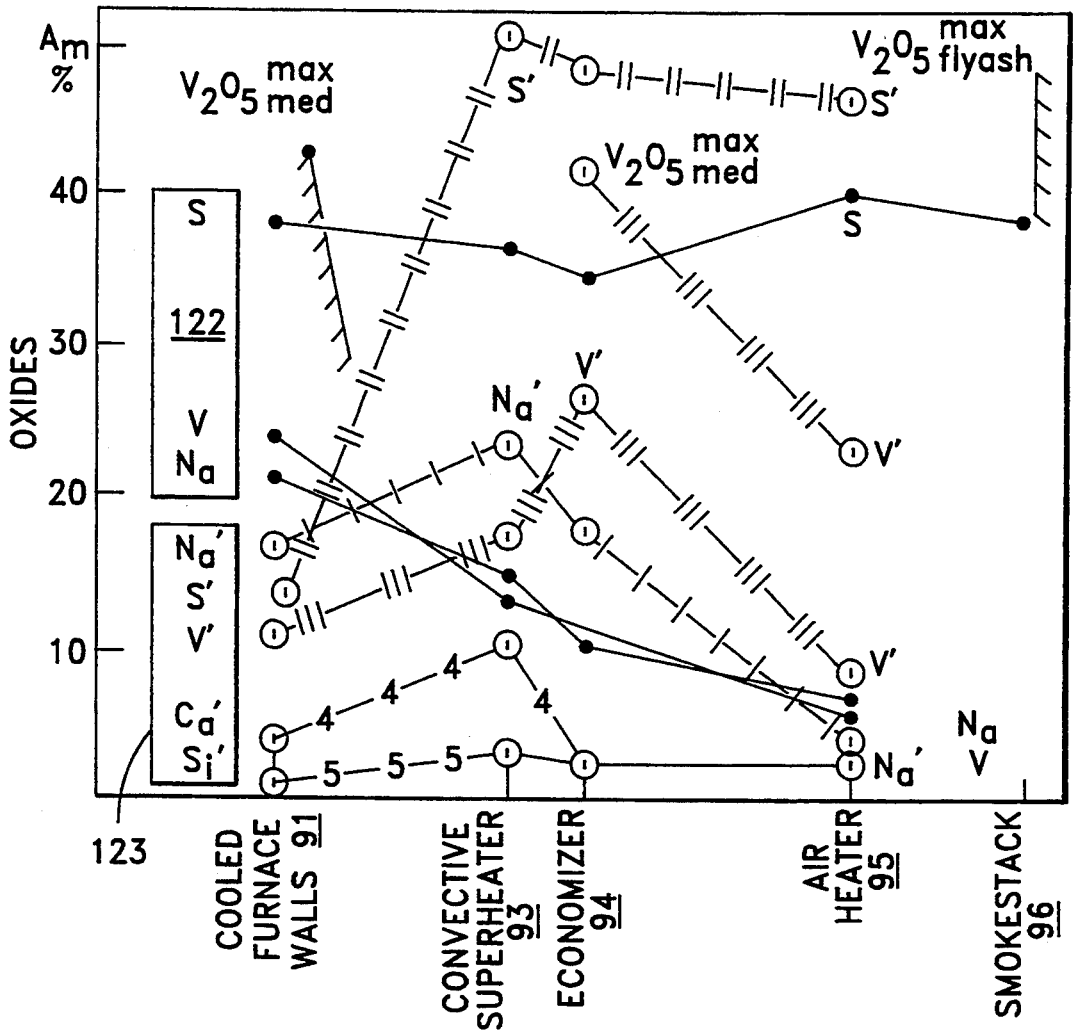
FIG. 9 graphically depicts the change in and the distribution of combustion by-products in a furnace resulting from use of the nozzle of FIG. 6.

When applied to the combustion process, the resulting dramatically increased energy release breaks atomic, molecular and crystalline bonds in the fuel and alters the type and distribution of combustion by products. FIG. 9 compares ash precipitation at various locations in a power plant with particular reference to the water cooled walls 91, convection super heater 93, economizer 94, air heater 95 and precipitator 96. Box 122 represents a furnace operation using conventional nozzles without Venturi tubes; box 123, nozzles constructed in accordance with the structure of FIG. 6. As shown in FIG. 9, vanadium compounds, particularly vanadium oxides, constitute one class of combustion by-products. With conventional nozzles (box 122), most of the vanadium oxides deposit in the vicinity of the water cooled walls 91. Using the nozzles 83 of FIG. 6 moves the vanadium oxides deposit downstream from the water cooled walls 91 to locations where they are more readily recovered. Moreover, reduction of sodium and vanadium compounds on the water cooled walls 91 allows surfaces to be scoured down to metal to maintain maximum heat transfer rates.

The use of the nozzle 83 in a furnace increases the vanadium oxides on cooler surfaces, such as the superheater 93 and economizer 94, by 20 to 40% because the energy of the bonds in sulphur, sodium and vanadium is lower than that of silicon (10, 17, 22 and 32 kJ/kg, respectively). With the furnace 123 the fuel droplets entering the burning zone are enriched with silicon and calcium. They form "-alite" compounds, such as $3CaOSiO_2$, with a high content of sodium and vanadium impurities and having a reduced coefficient of heat transfer. The percentage of the compounds that deposit diminishes because of a growing proportion of the compounds appear in fly ash. Moreover those compounds that do deposit form loose friable coatings that are readily removed.

External tube deposits are easily removed by washers 92 and produce a sludge with a higher content of vanadium, nickel, cobalt and titanium compounds that reduces their formation on the furnace walls 91. This increases heat utilization because the heat exchanger remain at maximum efficiency for longer intervals of time. The net effect is to increase overall furnace efficiency with concomitant reductions in operating costs and materials released to the atmosphere.

Figure 10:
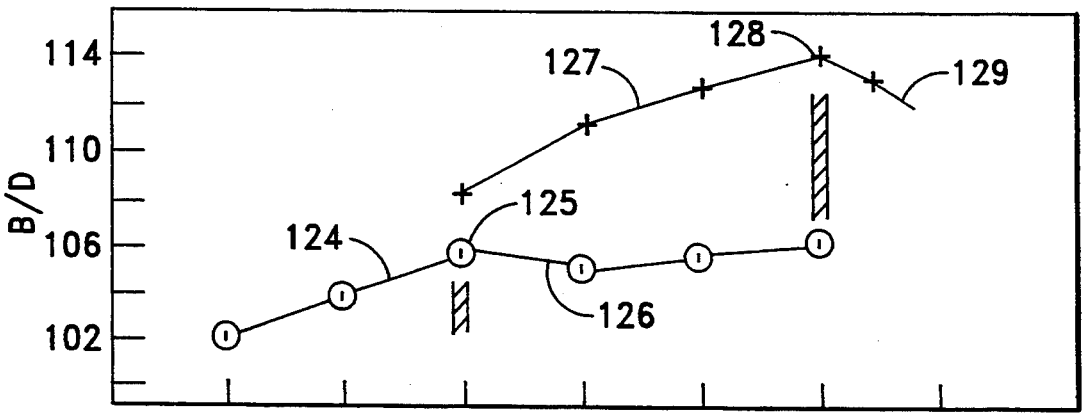
FIG. 10 graphically depicts improvements in fuel consumption afforded by substituting the nozzle shown in FIG. 6 in a furnace.

Referring to FIG. 10, curve 124 represents fuel required to produce a predetermined amount of steam with standard nozzles in the power plant of Example 1 and this fuel rate is increasing to the left of position 125. Position 125 represents the date on which the prior art swirling passages nozzles (Table 1, Example 1) were installed. The rise in fuel use before installation is attributed to the accumulation of deposits on various surfaces in the furnace that reduce overall furnace efficiency. After installation, the rate of fuel consumption decreased as shown by curve 126 so there was a corresponding increase in efficiency.

Curve 127 depicts increases in fuel use in the furnace using conventional nozzles until installation of nozzles constructed in accordance with FIG. 6 and Example II, Table 1 at point 128. Thereafter the rate of fuel use again decreased, apparently at a rate that was greater than the rate of decrease for the power plant of Example I.

These two experimental installations provided results that can be summarized qualitatively and quantitatively as follows:

1. The generation of useful heat per quantity of fuel increased by about 1.4% and overall plant efficiency increased by about 2.7%.
2. The air required to support combustion was reduced to 1.005 times the stoichiometric relationship thereby providing a more complete combustion and reducing certain combustion by-products.
3. The phase composition of finely dispersed and coarsely dispersed ash was changed and was enriched with calcium silicates.
4. Washing techniques replaced shot blasting thereby reducing maintenance efforts, and these techniques produced a sludge containing 20 to 40% of vanadium compounds from which vanadium and other metals could be reclaimed.
5. Pressure drops through various gas ducts was reduced.
6. The construction of the atomizer heads with the smooth ogive outer surfaces 120 reduced coking and minimized the need for nozzle cleaning.
7. Although the furnace of Example I reduced nitric oxides in the flue gases to 230 mg per cubic meter, the nozzles constructed in accordance with this invention reduced nitric oxides to 20 mg per cubic meter at the power station of Example II. Sulphur dioxide content was reduced by 1.5 times at the power plant of Example II.

In some applications increasing the fuel flow rate through a nozzle can lead to the formation of local disturbances and premature cavity collapse even with plural Venturi tubes as shown in FIG. 6. The capacity of a nozzle to meet such requirements can be attained by constructing a nozzle with an array of Venturi tubes at different points on concentric circles through a swirler plate such as the swirler plate 85 in FIG. 6. Each such additional Venturi tube will have a twisting arms $R'_y$, $R''_y$, for each circle, which, if the added Venturi tubes are positioned at greater radii, will have the relationship:

$$R_y < R'_y < R''_y \quad (17)$$

and the relation between the twisting arms and the exit orifice radius should comply with Equation (11).

In one embodiment this relationship and organization can be obtained if $$12° \leqq \alpha_1 \leqq 60° \quad (18)$$

Thus, for example, a nozzle could be constructed with three rings of four Venturi tubes each for a total of twelve linear Venturi tubes in the swirler plate 85.

Figure 11:
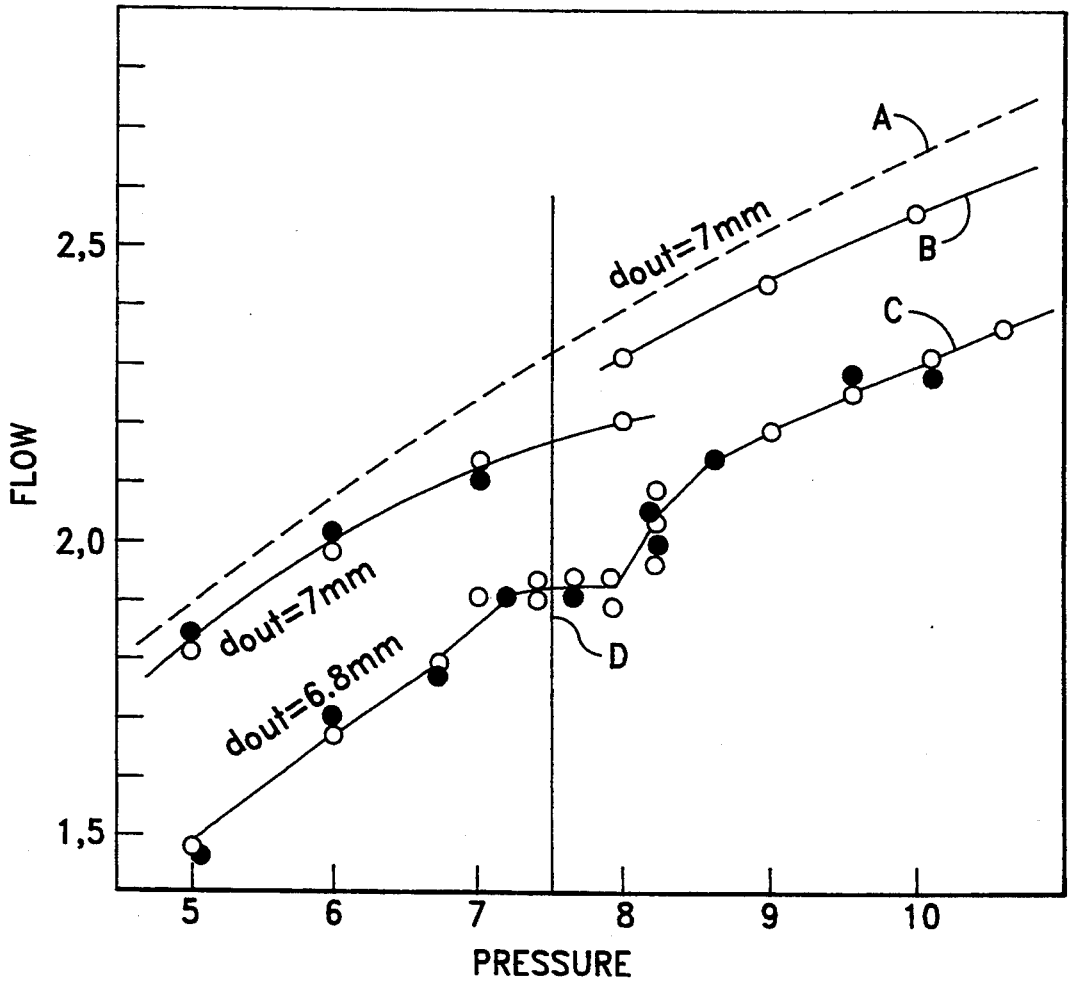
FIG. 11 is a graphical representation of the relationship between flow rates and pressure that is useful in understanding another aspect of this invention.

In FIG. 11, dashed line A represents a theoretical liquid flow through an exit orifice in a conventional nozzle as a function of input pressure on the liquid. During experimentation with nozzles constructed in accordance with my U.S.S.R. Inventor Certificate No. 1,708,436, it was discovered that during cavitation the flow rate became independent of pressure over a pressure range. Graphs B and C, for example, illustrate a plateau in the flow rate in a pressure range centered on a line D at about 7.5 atmospheres. It was also found that flow rate could be adjusted by varying the area of the exit orifice of the nozzle with a needle valve. Graphs B and C represent orifices with areas corresponding to orifice diameter of 7.0 and 6.8 mm respectively and illustrate a flow rate change of 1.9 to 2.2. Apparently the phenomena occurs when the liquid in the nozzle undergoes submerged flow to the exit orifice.

Figure 12:
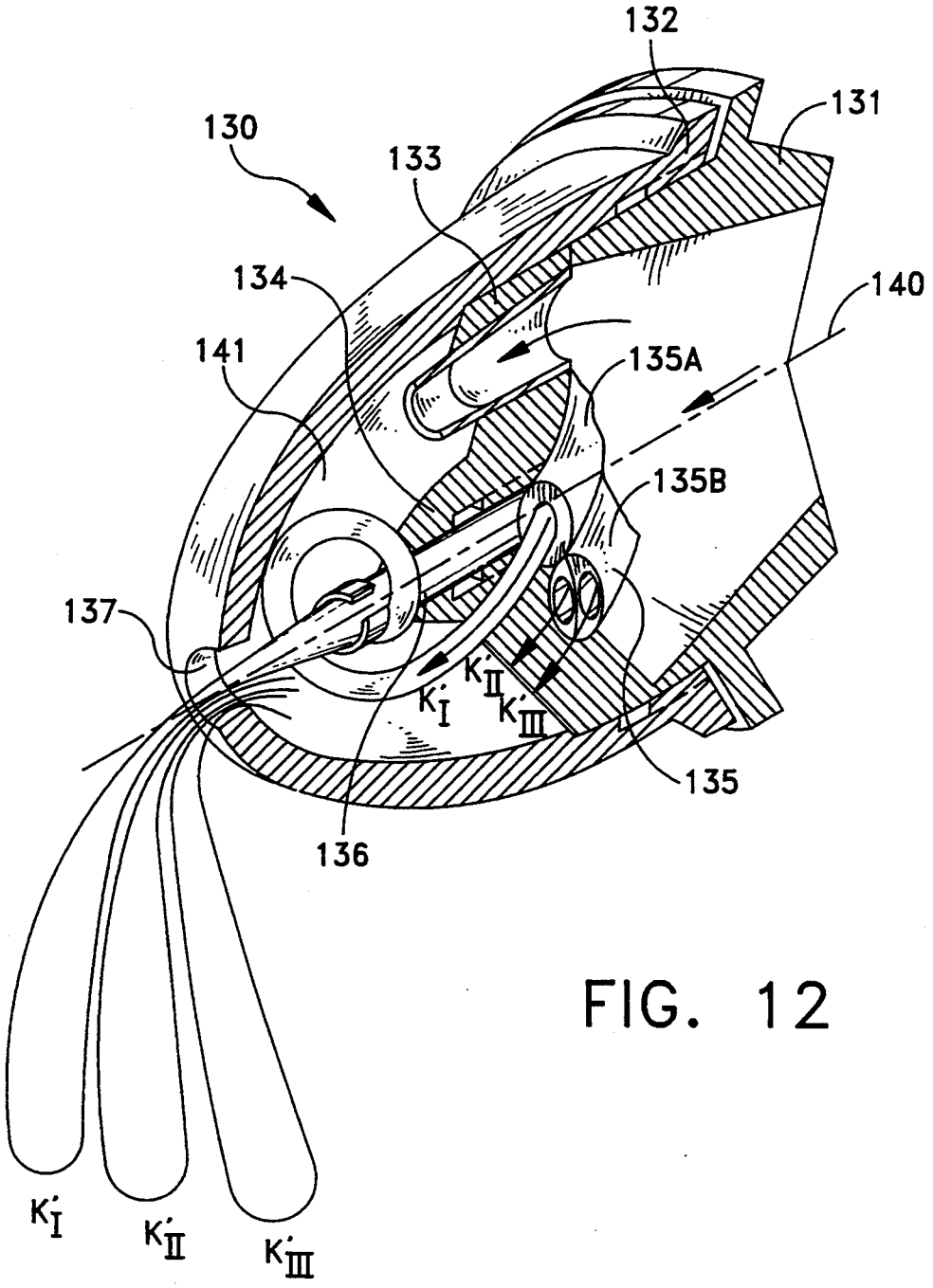
FIG. 12 is a view, partially broken away, of another embodiment of a nozzle constructed in accordance with this invention.
Figure 13:
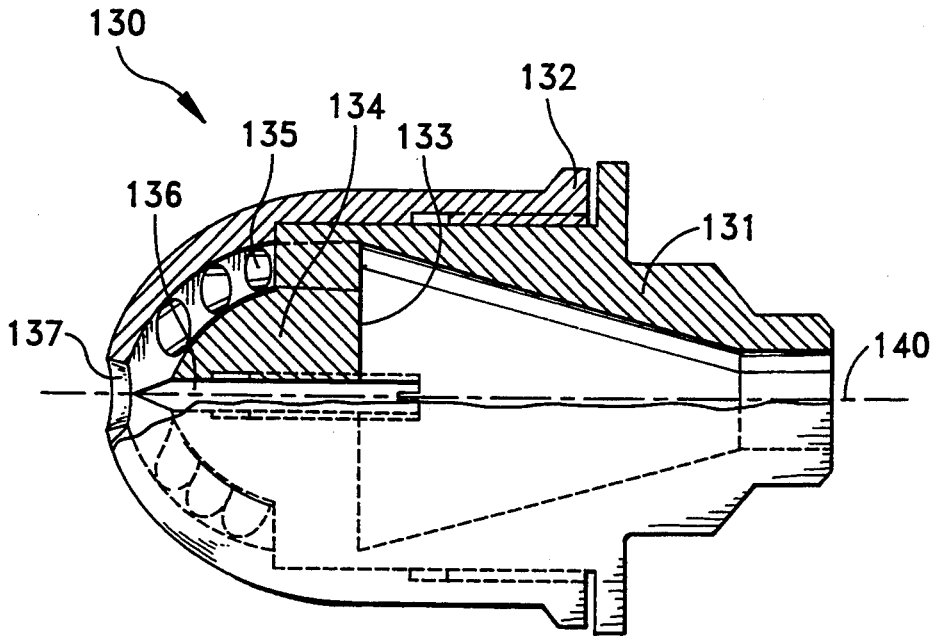
FIG. 13 is an side sectional view of the nozzle in FIG. 12.
Figure 14:
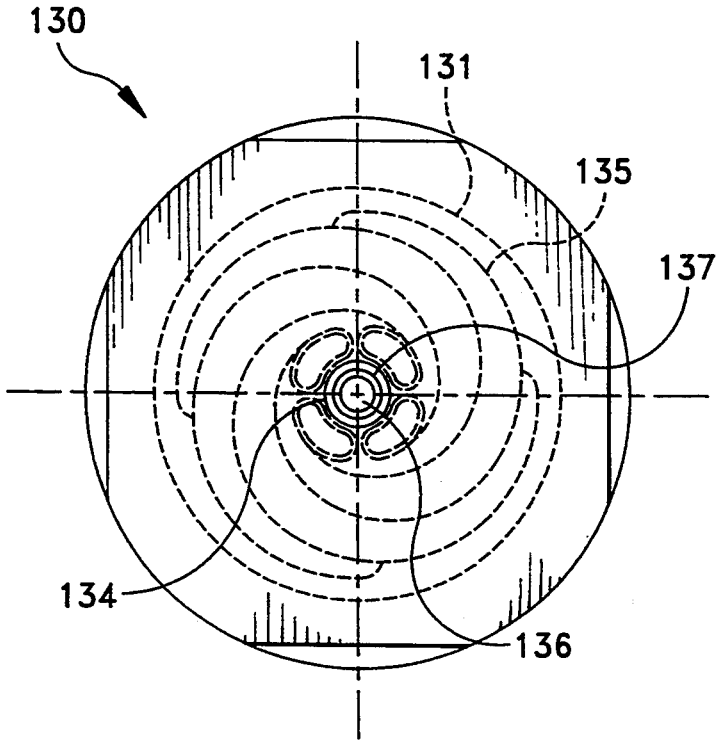
FIG. 14 is a view from a position downstream of the nozzle in FIGS. 12 and 13.

FIGS. 12 through 14 disclose an alternative apparatus that produces a submerged flow by using Venturi tubes that are elongated to extend along the converging spiral flow axes analogous to the structure shown in FIG. 6. More specifically, the nozzle 130 includes a diffuser 131, a casing or housing 132, a swirler 133 with a cowling 134 and a plurality of Venturi tubes 135 embedded in the swirler 133. Nozzles 135A and 135B are shown. A flow control needle valve 136 and an exit orifice 137 lie along a nozzle axis 140.

As particularly shown in FIGS. 13 and 14, the nozzle 130 includes a plurality of radially displaced Venturi tubes 135. Each of these Venturi tubes is flattened but retains the characteristics of structure and operation of Equations (5) through (10). As discussed with respect to FIG. 6, the Venturi tubes 135 also are arranged in tiers between the housing 132 and the cowling 134. As liquid passes from the diffuser 131 into each of the Venturi tubes 135, the liquid, that is assumed to include a gas or vapor content sufficient for cavitation as previously described, begins to form cavity centers along the converging spiral flow path axes. Each separate jet in a first tier defines cavities that flow along a flow path $K_I$; in a second tier, along flow path $K_{II}$. All these paths spiral and converge between the housing 132 and the control needle valve 136 after passing through outside the cowling 134. The individual flow paths combine in a rotating ring to pass between the exit orifice 137 and the needle control valve 136.

Liquid may also be swirled along a spiral converging flow path $K_{III}$ that carries a liquid film past the exit orifice 137 at a velocity that exceeds the velocity along the flow paths $K_I$ and $K_{II}$. The static pressure on the liquid at the flow path $K_{III}$ therefore is lower than that on the liquid at flow paths $K_I$ and $K_{II}$, so the cavities continue to expand even after the liquid emerges from the exit orifice 137. When the different liquid streams emerge from the exit orifice 137, they form tongues $K'_I$, $K'_{II}$, $K'_{III}$. Once the liquid in the tongue K' disperses, the cavities begin to collapse producing corresponding high velocity, high temperature gas jets pointing in all directions. As the tongues $K'_I$ and $K'_{II}$ form an essentially thin film, separate eroded particles of micrometer and submicrometer size emerge from the film. As with other nozzles using my invention, the energy released during cavity collapse is capable of splitting atomic, molecular and crystalline bonds.

In one particular embodiment, the liquid velocity and nozzle construction produce a flow rate characterized by a Reynold's number in the order of 10,000 and with the nozzles extending from $3d_n$ to $20d_n$ along the converging spiral paths. Liquid emanating from each of the Venturi tubes in a near axis region of each jet produces a cavitating zone that constitutes about 8% to 10% of the volume of liquid passing through the Venturi tubes. Swirling the jets emanating from the nozzles along the converging spiral paths produces a liquid layer at the output opening and improves the distribution of cavities through the liquid as previously indicated.

The needle valve 136 displaces along the nozzle axis 140 to control the flow of liquid through the nozzle because, as shown in FIG. 11, the flow rate in the cavitating mode is independent of pressure. If the effective area of the exit orifice 137 is reduced, as by advancing the needle valve 136, the flow rate decreases independently of pressure and the cavitation effect is retained. In one particular embodiment reducing the effective opening from an area corresponding to a 7 mm circle to the area of a 6.8 mm circle decreased the flow rate from 2.2 to 1.9 tons/hr at the constant pressure of 7.5 atmospheres. This control also enhances the uniformity of filling the various tongues or films emerging from the nozzle 130 and minimizes back flow of the cavitating jets so that they do not produce the kinds of local disturbances that could cause premature cavity collapse within the nozzle 130.

In the structure shown in FIGS. 12 through 14, however, the jets emerging from the Venturi nozzles are submerged in liquid that can fill a volume 141 between the housing 132 and cowling 134 as previously described with respect to FIG. 6. The extension of the Venturi tubes, particularly the exit cones, along the spiral converging paths can reduce the potential for such back flow and the creation of local disturbances.

Figure 16:
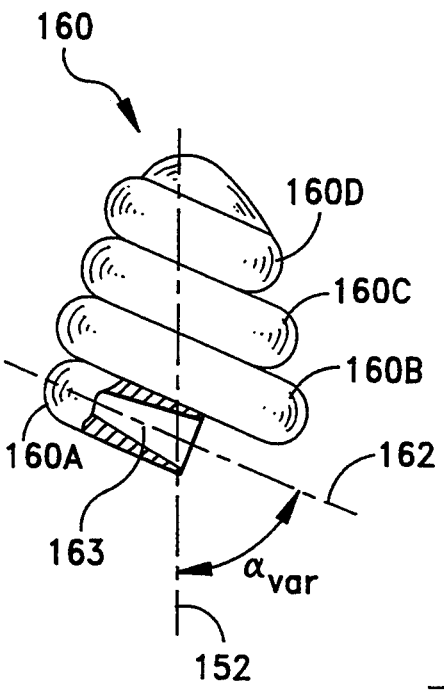
FIGS. 16 and 17 are detailed views of portions of the nozzle in FIG. 15.
Figure 15:
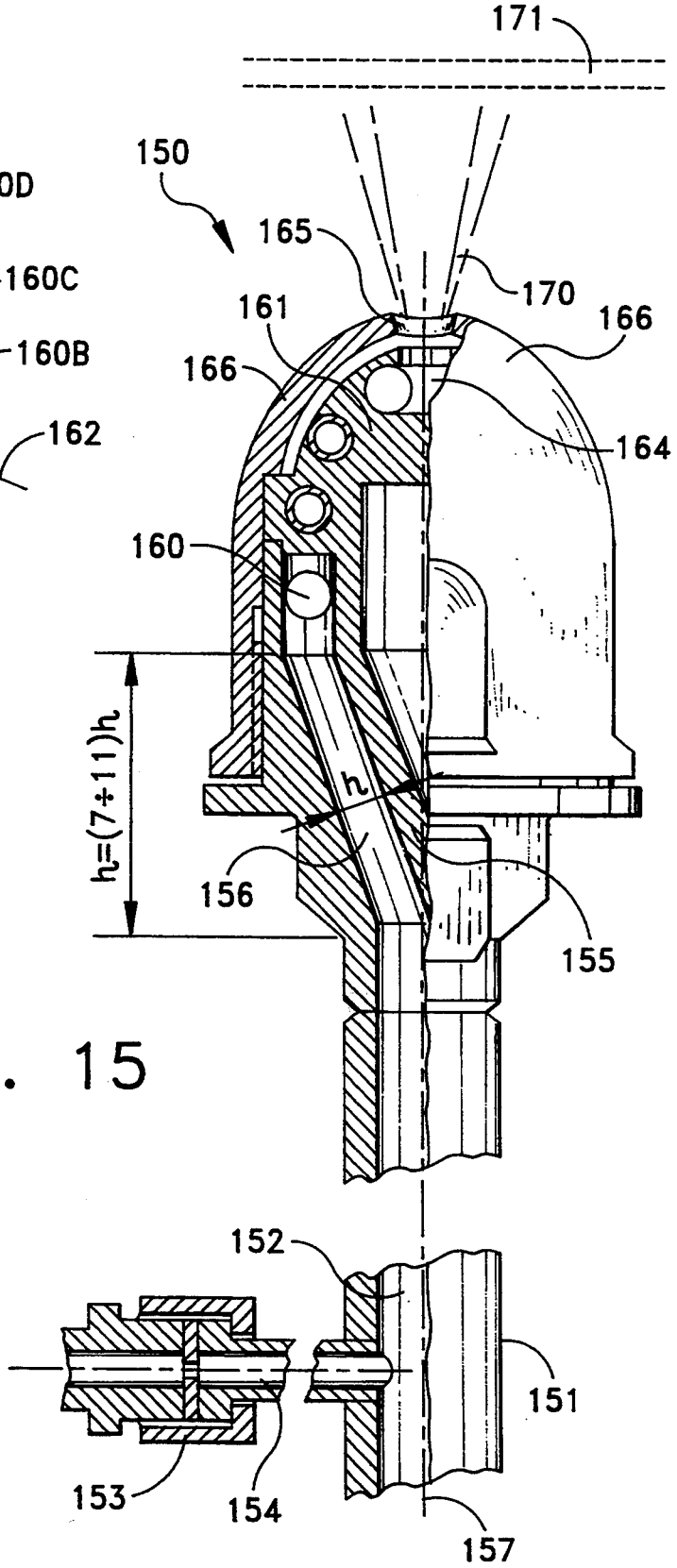
FIG. 15 is a view, partially in section, of another embodiment of a nozzle constructed in accordance with this invention.
Figure 17:
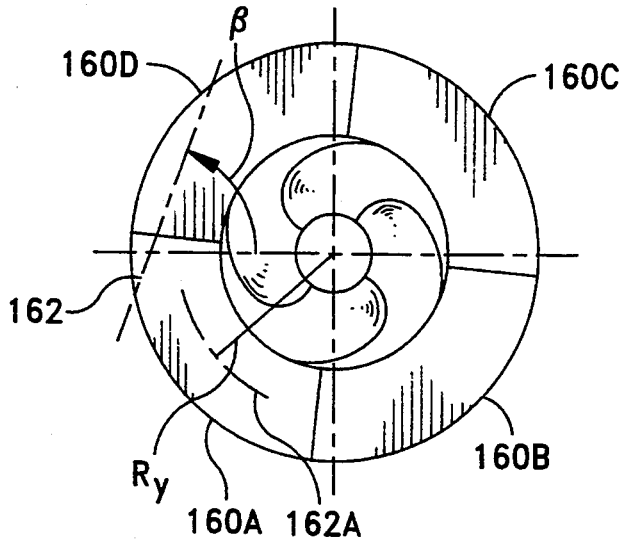

Another nozzle embodiment shown in FIGS. 15 through 17 minimizes any potential for problems caused by submerged flow within the nozzle. This nozzle 150 attaches to a supply pipe 151 that provides a liquid 152 to be atomized. The pipe 151 may optionally connect to an injector 153 for introducing a gas or vapor 154 in order to achieve a concentration of the gas phase of between $10^{-3}$ to $10^{-2}$ fractions of the total fuel mass. As previously indicated, such injection is not necessary if the liquid 152 inherently contains a gas phase concentration of that order.

The liquid 152 with its entrained gas 154 flows to a cone 155 that directs the liquid into a circular flow in an annular passage 156. The annular passage 156 has a radial opening or thickness "h" and an axial length "$L_c$" of $$7h \leqq L_c \leqq 11h \quad (19)$$

in order to produce laminar flow within the annular passage 156. The annular passage 156 additionally begins to swirl the liquid toward a nozzle axis 157 while maintaining the laminar flow thereby to introduce a velocity and momentum component in a plane normal to the nozzle axis 157. The annular passage 156 also directs the liquid to a Venturi tube cartridge 160 that contains a plurality of Venturi tubes. In this particular embodiment the Venturi nozzle cartridge 160 contains four nozzles 160A, 160B, 160C and 160D all supported in a base 161. The entrance cone diameter and the tubular channel diameter are the same and the entrance cones form extensions of the annular passage 156. Each of the Venturi tubes, such as Venturi tube 160A, wraps about the axis 157 along a converging spiral path having a pitch angle of $\alpha_{var}$ wherein $\alpha_{var}<90°$. A Venturi axis 162 corresponding to the spiral path at the beginning of entrance cone 163 defines an angle "$\beta$" with respect to a reference axis 166 in the range $0° \leqq \beta \leqq 90°$.

The nozzle 150 in FIGS. 15 through 17 also defines a twisting arm $R_y$ that represents a radius from the nozzle axis 157 to the flow axis at the entrance to a Venturi tube, such as axis 162A for Venturi tube 160A. Equation (11) again relates the ratio of $R_y$ to $R_{noz}$, the radius of the exit orifice 165.

Each of the Venturi tubes 160A through 160D is constructed in a manner that is analogous to each of the previously described Venturi tubes. Each has its entrance cone, such as entrance cone 163 shown in FIG. 16, followed by a throat and an exit cone that are not shown in these figures. Each of the Venturi tubes 160A through 160D is constructed to and operates in accordance with the criteria established in each of Equations (5) through (10) above. In each the exit cone diverges at a variable angle that, in a preferred form, has a divergence angle of 0° at the throat and of 6° at an exit port of the exit cone. Each is machined and finished to avoid the formation of any local disturbances within the respective Venturi tubes 160A through 160D.

Liquid flows through each Venturi tube at a velocity that provides a Reynold's number greater than 2300 to form cavities in the throat that begin to grow as the liquid passes through the exit cone. The liquid emerges in a plurality of tangential streams in a vortex chamber 164 formed at a tip of the housing 161 adjacent an exit orifice 165 formed in a nozzle cover 166. As shown in FIG. 16 the nozzle cover 166 conforms to an ogive thereby to provide a smooth exterior surface that allows air to pass over the nozzle without significant recirculation or carbon deposit as previously described.

The liquid streams emerge from each of the Venturi tubes 160A through 160D into the vortex chamber 164 with axial and radial velocity components. The radial velocity component allows swirling of the liquids and a dispersing of the cavities that continue to grow in the vortex chamber 164. The axial velocity component displaces the swirling liquid out of the exit orifice 165 in a conical film structure 170 that expands radially until the static pressure on the liquid reaches a threshold at which the cavities begin to collapse. The exact distance between the exit orifice 165 and this zone of collapse designated 171 depends upon the external pressure acting on and the axial velocity of the liquid in the film 170.

The use of the Venturi tube cartridge 160 and base 161 eliminates the requirement of passing liquid streams through liquids that fill larger volumes such as the volume between the cowling 134 and housing 132 in FIG. 12. This embodiment therefore minimizes the potential for eddy formation within the nozzle that could produce a local disturbance and initiate premature bubble collapse. Thus, the nozzle 150 produces a mean energy release in the zone of collapse approaching or even exceeding 400 $W/m^2$.

The operation of the nozzle 150 shown in FIGS. 15 through 17 is analogous to the other specific nozzle embodiments described previously. Liquid 152 to be atomized passes into the passages 156 that produce a laminar flow and introduce radial and axial velocity components to the liquid. Providing this momentum change under laminar flow conditions has several positive effects. First, laminar flow minimizes the creation of any back pressure through the nozzle so the pressure drop across the nozzle 150 is reduced. Secondly, the momentum changes allow the liquid to pass through the Venturi tubes 160A through 160D with a minimum potential for the introduction of local disturbances and premature cavity collapse.

As the liquid passes into the Venturi tubes 160A through 160D, the Reynold's number exceeds 2300. The liquid static pressure drops as the liquid passes through the throat section so the entrained gas can begin to produce expanding cavities that distribute with a maximum density along the locus of maximum liquid flow velocity.

As the streams with the entrained gas bubbles concentrated along the loci of maximum flow velocity emerge from the Venturi tubes 160A through 160D, they swirl in the vortex chamber 164 to disperse the cavities more uniformly throughout the liquid. Then the liquid emerges from the exit orifice 165 in the film 170 and is carried axially away from the nozzle 150 until the static pressure produces cavity collapse in the zone of collapse 171 where cavity collapse produces micron and submicron particles and may break atomic, molecular and crystalline bonds.

As previously indicated, it is an important feature of this invention that the liquid being atomized have a gas phase concentration of about 1.5%. The following describes a process for obtaining the optimal gas concentration and is applicable to each of the nozzle embodiments previously disclosed. For purposes of clarity, it will be discussed in detail with respect to the nozzle shown in FIG. 15.

More particularly, the liquid 152 can be constituted either by a liquid or an emulsion phase suspended in the liquid that is supplied at a pressure $P_0$ which is a fraction of the high pressure used in conventional atomizers. Steam, hydrogen, methane and other gases can be introduced through the injector 153 into the liquid 152 under a pressure $P_1$ that is greater than $P_0$ by an amount sufficient to guarantee the introduction of the gas into the liquid. The injector 153 connects to the pipe 151 at a distance $L_i$ from the exit orifice 165 that is related to the exit orifice diameter, $d_{or}$ by:

$$l_i \geqq 10 d_{or} \tag{20}$$

This distance allows the introduced gas to mix uniformly in the liquid before the mixture approaches the Venturi tube structure such as the Venturi tube cartridge 160.

The acceleration produced by swirling the stream through Venturi tubes such as shown in FIGS. 6 through 8, 12 through 14 and 15 through 17 concentrates the gas stream. As the liquid passes along the converging spiral paths established in these nozzles, the gas particles shift toward the central nozzle axis and increase the vapor content in those portions of the stream where the static pressure decreases. This facilitates cavity nucleation and growth as previously described.

The introduction of the vapor to optimize the concentration level has the effect of facilitating many of the advantages of nozzles embodying this invention. When such nozzles are used for atomizing fuel, for example, operating a liquid with an optimal gas concentration has the particular effect of assuring a maximum reduction in the issue of toxic gases, such as nitric oxide, as a combustion by-product.

Figure 18:
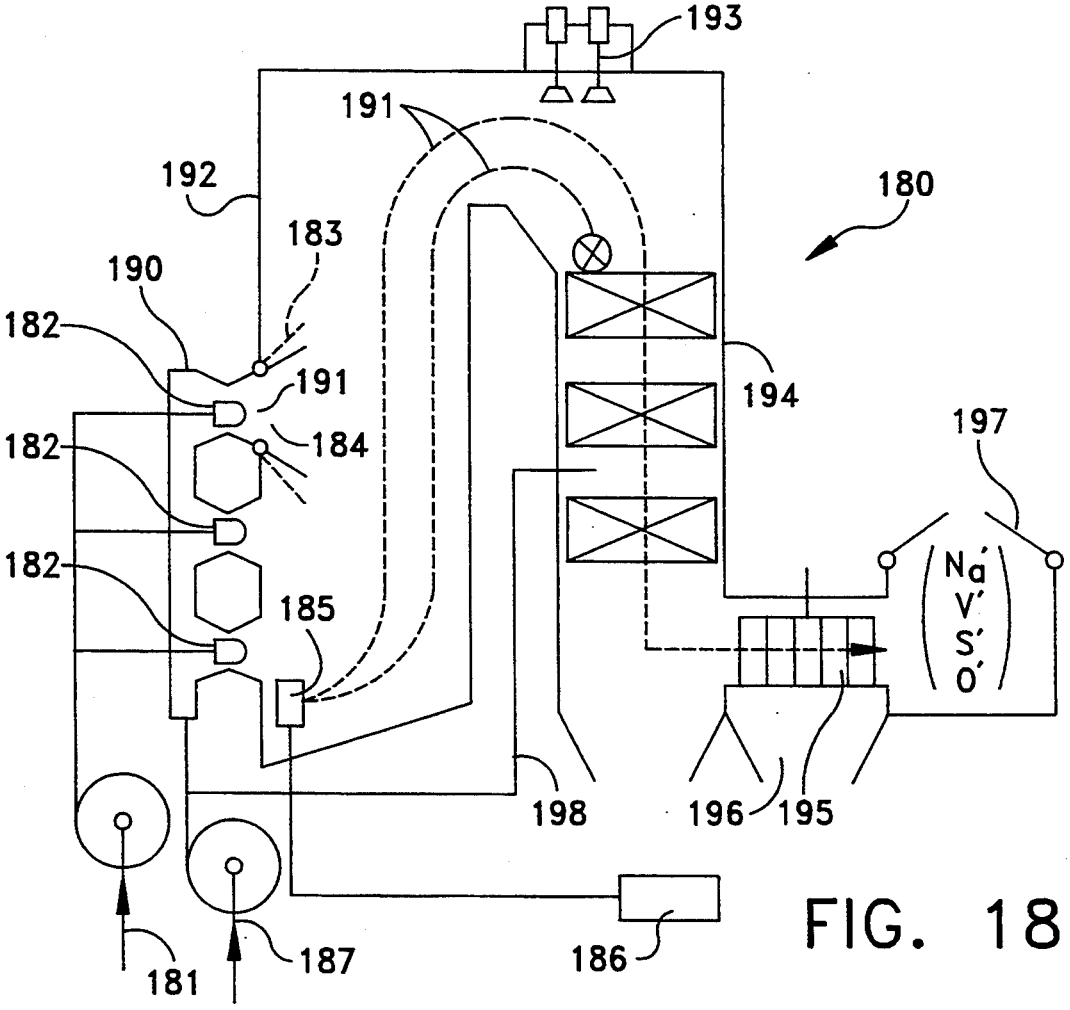
FIG. 18 is a diagram of apparatus modified to control a zone of collapse.

In some applications it is also important to control the amplitude of the shock forces that occur when the cavities collapse. FIG. 18 depicts a furnace 180 for use in a power plant, steam generating plant or the like, that includes a fuel system 181 for supplying fuel under pressure to a plurality of nozzles 182 constructed in accordance with this invention. Each nozzle emits a fuel in a conical film such as film 183 into a combustion chamber 184. A piezoelectric transducer 185 responds to cavity collapse by providing an output signal to a display 186 that indicates the amplitude of cavity collapse exteriorly of the nozzles 182. An air supply system 187 pumps air into a plenum 190 with a series of embrasures 191 at each of the nozzles 182. Combustion by-products represented by dashed lines 191 leave the furnace through a variety of apparatus that may include water cooled walls 192, washers 193, a series of heat exchangers 194, such as superheaters and economizers, and precipitators 195 to exit out a smokestack 196. A gate 197 provides alternate access for cleaning the precipitator 195. A line 198 represents a system for returning combustion by-products from the heat exchangers 194 to the combustion chamber 184. Such a system generally comprises a pumping system to return the by-products under pressure. In a basic system, an operator or a control system can then adjust the discharge flow rate from and pressure of the pump 187 or the system 198 to adjust the pressure of the atmosphere in the combustion chamber 184.

In either a vacuum or supercharged furnace, control of the absolute pressure, $P_a$, acting on the film 183 determines the amplitude of the cavitation. More specifically, the absolute pressure acting on the film 183 with its expanding cavities depends upon the static pressure of the liquid, $P_\infty$, and a pressure, $P_b$, of the atmosphere in the combustion chamber 184. That is:

$$P_a = P_b \pm P_\infty \tag{21}$$

Thus, it is possible to control the absolute pressure, Pa, and the cavity collapse process in the combustion chamber 184 by controlling the pressure of the atmosphere in the combustion chamber 184.

Moreover, if $P_\infty$ and $V_\infty$ correspond to the static pressure and velocity of the liquid at the inlet or outlet of a cavitation nozzle 182 and if $P_{min}$ and $V_{max}$ correspond to the pressure and velocity in the constricted section of the flow as in the throat, the cavitation activity grows with static pressure and the relationship of potential and kinetic energies in the two areas must satisfy Bernoulli's theorem as follows:

$$P_\infty + \frac{V_\infty{}^2}{2g_o} = P_{min} + \frac{V_{max}^2}{2g_o} \tag{22}$$

Assuming that the liquid contains a gas such as steam with a pressure $P_s$, cavitation begins when the minimum pressure in the constricted section of flow is less than the pressure of the gas. Conversely, when the absolute pressure acting on the liquid rises, either by an increase in the atmospheric pressure, $P_b$, or the static pressure, $P_\infty$, cavity collapse begins as previously indicated and in accordance with Equations (21) and (22). Thus, controlling the air pressure through the embrasures 191 can control the cavity collapse process by establishing the absolute pressure (i.e., $P_a$) through adjustment of the atmospheric pressure, $P_b$, in the combustion chamber 184.

Figure 19:
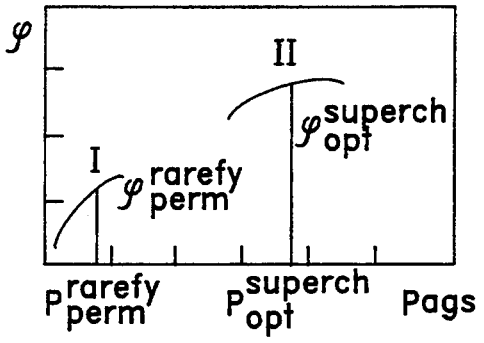
FIG. 19 graphically depicts the relationship between energy release and pressure.

FIG. 19 depicts the relationship of the energy release to the pressure in two particular furnaces. Curve I corresponds to a furnace operating under vacuum while the Curve II corresponds to a supercharged furnace. In a furnace running under vacuum pressure will have an upper limit of $P_{vac\text{-}max}$ in order for proper furnace control to continue. In supercharged furnaces the absolute pressure $P_{sup\text{-}opt}$ which can be obtained by recirculating air taken from one of the heat exchangers 194, or by changing the flow from the plenum 190 through the embrasures 191.

In summary, each of the nozzles constructed in accordance with this invention and shown in FIGS. 1A, 1B, 1C, 4, 5, 6 through 8, 12 through 14 and 15 through 17 has common characteristics. Each uses one or more specially constructed Venturi tubes to enable the formation of cavities and continued growth of those cavities within the liquid. In each, cavity collapse does not occur until the cavities emerge from the nozzle. In each embodiment the nozzle structure satisfies the various criteria established by Equations (5) through (10). Each assures that the liquid static pressure acting on the bubbles can not rise above the threshold that produces cavity collapse by minimizing any pressures exerted by external influences outside the nozzle and by minimizing the potential for the formation of localized disturbances within the nozzle. Localized disturbances are minimized in each by providing a Venturi tube with an exit cone that diverges at a variable angle preferably in the range of 0° at a throat and at 6° at an exit port. Surface finishes are controlled to minimize surface irregularities that could also disturb liquid flow through the Venturi tube and produce a localized increased static pressure. The exit cone in each Venturi tube extends some distance along a flow axis to further minimize the impact of external pressures. In a preferred form the exit cones have a length of $2d_n$ to $20d_n$ where $d_n$ represents the throat dimension.

When a nozzle is constructed in accordance with these basic parameters and other parameters enumerated above, the nozzle dispenses a film or stream with growing cavities that collapse exteriorly to the nozzle. The energy and shock forces released by that collapse is sufficient to break atomic, molecular and crystalline bonds and to reduce the liquid into micron and submicron droplets. All this occurs without the collapse producing any adverse effects, such as metal erosion, on any portion of the nozzle and without the application of additional energy from external sources, such as ultrasound generators and the like proposed in the prior art.

Nozzles constructed in accordance with the basic parameters established by this invention can be used in a wide variety of applications. As previously indicated these nozzles can improve the dispersal of fuel oils thereby to improve burning efficiency to reduce the level of certain combustion by-products and to facilitate maintenance of a furnace. Such nozzles can also be adapted for use in fuel injected aircraft and automobile engines. The ability to break atomic, molecular and crystalline bonds adapts such nozzles for use in refining processes and preparing fuel emulsions in processing waste and other oil products as well as other chemical processes. The energy released by the external cavitation can be used to treat surfaces or films as in cleaning systems or for altering matter for low or high temperature reactions. Still other applications have been discussed.

This invention has been disclosed in terms of certain embodiments. It will be apparent that many modifications can be made to the specifically disclosed nozzle embodiment without departing from the invention. Therefore, it is the intent of the appended claims to cover all such variations and modifications as come within the true spirit and scope of this invention.

What is claimed as new and desired to be secured by Letters Patent of the United States is:

1. A nozzle for atomizing a liquid received from a supply means in non-atomized form under pressure with a gas dissolved therein, said nozzle comprising means for forming a Venturi tube with a converging entrance cone for receiving the liquid from the supply means, a throat of a substantially constant transverse dimension "$d_n$" that defines an included angle in the throat of substantially 0° and that increases the velocity and reduces the static pressure of the liquid, and an exit cone for conveying liquid from said throat to an exit port, said exit cone being characterized by an included angle of divergence that, over at least a portion of the distance from said throat, increases from the included angle of said throat to a maximum angle as a function of the distance from the throat and, at any given position displaced from said throat, is greater than or equal to an included angle at any position intermediate said throat and the given position and by a length "l" of at least about $d_n$ wherein the supply means delivers the liquid to said throat under conditions that enable the formation of gas cavities in the liquid, wherein said exit cone maintains the static pressure of the liquid at a level that enables the gas cavities to expand in said exit cone, and wherein said throat and exit cone convey the liquid in a substantially disturbance-free flow whereby the liquid static pressure increases to a level that initiates gas cavity collapse only after the gas cavities leave said nozzle, the gas cavity collapse producing forces that atomize the liquid.

2. A nozzle as recited in claim 1 wherein said exit cone included angle increases to a maximum of 6°.

3. A nozzle as recited in claim 1 wherein said exit cone included angle increases continuously from said throat to said exit port.

4. A nozzle as recited in claim 1 wherein said exit cone included angle increases continuously from 0° at said throat to about 6° at said exit port.

5. A nozzle as recited in claim 1 wherein exit cone length is between $3d_n$ and $20d_n$.

6. A nozzle as recited in claim 1 wherein said entrance cone, throat and exit cone lie along a straight nozzle axis.

7. A nozzle as recited in claim 1 wherein said entrance cone, throat and exit cone lie along a nozzle axis that defines a planar arc.

8. A nozzle as recited in claim 1 wherein the nozzle includes a nozzle axis defining a flow path for liquid emerging from said nozzle and said entrance cone lies on an axis that is displaced from said nozzle axis, said entrance cone, throat and exit cone lying along a spiral axis that converges toward the nozzle axis.

9. A nozzle as recited in claim 8 wherein said nozzle includes flow directing means between the liquid supply means and said entrance cone for imparting to the liquid a velocity component along the spiral converging path.

10. A nozzle as recited in claim 1 wherein the surfaces of said entrance cone, throat and exit cone have surface irregularities that are less than 1 μm.

11. A nozzle as recited in claim 1 wherein the surfaces of said entrance cone, throat and exit cone have surface irregularities that are less than 0.63 μm.

12. A nozzle as recited in claim 1 wherein said exit cone has a length in the range $3d_n$ to $20d_n$ and diverges at an included angle that is 0° at said throat and 6° at said exit port and wherein the surface of said entrance cone, throat and exit cone have surface irregularities that are less than 0.63 μm.

13. A nozzle apparatus for atomizing a liquid received from a supply means in non-atomized form under pressure with a gas dissolved therein, said nozzle apparatus comprising:

A. inlet means for connection to the liquid supply for receiving the liquid,

B. housing means attached to said inlet means and forming an exit orifice, said inlet means and exit orifice defining a nozzle axis, C. a plurality of Venturi tubes intermediate said inlet means to said exit orifice, each Venturi tube directing the liquid along a flow path and having an entrance cone for receiving a portion of the liquid from said inlet means, a throat portion of diameter "$d_n$" for increasing the velocity and reducing the static pressure of the liquid thereby to initiate gas cavity nucleation and growth in the liquid, and an exit cone for conveying liquid and growing cavities from said throat to an exit port proximate said exit orifice, each said exit cone diverging at an included angle of 0° at said throat to a maximum included angle at said exit port and having a length along the Venturi tube flow path of at least $d_n$, said housing means directing the liquid and growing cavities from said plurality of Venturi tubes to said exit orifice thereby to discharge said liquid from said nozzle apparatus whereupon the cavities collapse and generate shock forces that divide the liquid into fine particles.

14. A nozzle apparatus as recited in claim 13, wherein the included angle of each said exit cone increases to a maximum of 6°.

15. A nozzle as recited in claim 13 wherein the included angle of each said exit cone increases continuously from said throat to said exit port.

16. A nozzle as recited in claim 13 wherein the length of each axis exit cone is between $3d_n$ and $20d_n$.

17. A nozzle apparatus as recited in claim 13 additionally comprising means for mixing a gas into the liquid intermediate said inlet means and said Venturi entrance cones.

18. A nozzle apparatus as recited in claim 13 additionally comprising means for mixing a gas into the liquid intermediate said inlet means and said Venturi entrance cones, said means producing a gas concentration of about 1.5%.

19. A nozzle apparatus as recited in claim 10 wherein said nozzle apparatus includes diffusion chamber means intermediate said inlet means and said Venturi entrance cones and means for conveying gas into said diffusion chamber means at a gas entrance.

20. A nozzle apparatus as recited in claim 19 wherein the distance between said gas entrance and said exit orifice is at least ten times the diameter of the exit orifice.

21. A nozzle apparatus as recited in claim 13 wherein said nozzle apparatus discharges into a closed chamber and said closed chamber additionally comprises means for regulating the pressure therein for controlling the amplitude of the energy released during cavity collapse.

22. A nozzle apparatus as recited in claim 13 wherein said housing forms a cylindrical vortex chamber located on the nozzle axis in communication with the exit orifice and wherein each of said Venturi tubes is characterized by a straight flow path that intersects the vortex chamber along a Venturi axis that is spaced from the nozzle axis.

23. A nozzle apparatus as recited in claim 22 wherein said each of said Venturi tubes is equiangularly displaced about said vortex chamber and lies on a radial from said vortex chamber and each of said Venturi tubes being positioned to locate the Venturi axis to intersect a line normal to the radial at an angle e to produce swirling in said vortex chamber and to intersect an offset axis parallel to said nozzle axis at an angle $\beta$ thereby to impart momentum along the nozzle axis that causes the liquid to pass through said exit orifice.

24. A nozzle apparatus as recited in claim 23 wherein the angle $0° \leqq \alpha \leqq 90°$ and $0° \leqq \beta \leqq 90°$.

25. A nozzle apparatus as recited in claim 24 wherein the distances between the radial for each Venturi and the Venturi axis constitute a twisting arm radius $R_y$ and the exit orifice is circular and has a radius $R_{noz}$ and the ratio of the twisting arm radius and exit orifice is given by:

$$\frac{R_y}{R_{noz}} \geqq 1.$$

26. A nozzle apparatus as recited in claim 23 additionally comprising an annular liquid manifold lying in a plane normal to the nozzle axis for conveying liquid to the entrance cone of each of said Venturi tubes in parallel.

27. A nozzle apparatus as recited in claim 26 wherein $\alpha \approx 90°$ and $\beta \approx 70°$ and wherein the distances between the radial for each Venturi and the Venturi axis constitute a twisting arm radius $R_y$ and the exit orifice is circular and has a radius $R_{noz}$ and the ratio of the twisting arm radius and exit orifice is given by:

$$\frac{R_y}{R_{noz}} \geqq 1$$

whereby liquid introduced to said Venturi tubes with a Reynold's number $>2300$ produces an energy release downstream of said exit orifice in the order of 300 watts per square meter.

28. A nozzle apparatus as recited in claim 13 wherein the liquid admitted to said nozzle is a fuel and said housing means has an outer surface forming an ogive surface terminating at said exit orifice for providing a combustion air flow surface to atomized fuel exiting said nozzle apparatus.

29. A nozzle apparatus as recited in claim 28 wherein said nozzle apparatus discharges into a closed chamber and said closed chamber additionally comprises means for regulating the pressure therein thereby to control the amplitude of the energy released during cavity collapse.

30. A nozzle apparatus as recited in claim 28 wherein said nozzle apparatus additionally including swirler means disposed intermediate the supply means and said throat of each said Venturi tube for imparting angular momentum to the liquid thereby to produce a swirling of said liquid within said nozzle apparatus that converges toward said exit orifice.

31. A nozzle apparatus as recited in claim 30 wherein each of said plurality of Venturi tubes is disposed about the nozzle axis to align with the converging spiral flow and wherein said housing means additionally forms spaced ogive internal surfaces communicating with said exit orifice for containing the spiral flow produced by said swirler means.

32. A nozzle apparatus as recited in claim 31 wherein said swirler means includes a plate located in said nozzle apparatus containing each of said Venturi tubes as portions thereof and a input passage intermediate said inlet means and each said entrance cone, each said Venturi tube and corresponding input and input passage lying along an axis that is skewed with respect to the plane of said plate.

33. A nozzle apparatus as recited in claim 32 wherein said exit cone in each of said Venturi tubes extends along its corresponding axis by a distance between $d_n$ and $2d_n$.

34. A nozzle apparatus as recited in claim 32 wherein $\alpha_1$ represents an angle in the plane of said swirler plate between the Venturi tube axis and a line from the center of the swirler plate through the center of said entrance cone, wherein $\alpha_2$ represents an angle between the plane of said swirler plate and the axis through the Venturi tube and wherein $40° \leqq \alpha_1 \leqq 72°$ and $15° \leqq \alpha_2 60°$.

35. A nozzle apparatus as recited in claim 34 wherein said exit cone in each of said Venturi tubes extends along its corresponding axis by a distance between $d_n$ and $2d_n$.

36. A nozzle apparatus as recited in claim 35 wherein the distance between said nozzle axis and said entrance cone in each of said Venturi tubes constitutes a twisting arm radius $R_y$, the exit orifice is circular and has a radius $R_{noz}$ and the ratio of the twisting arm radius and exit orifice is given by:

$$\frac{R_y}{R_{noz}} \geqq 1.$$

37. A nozzle apparatus as recited in claim 36 wherein the total inlet area to the Venturi tubes is $A_{in}$ and the area of said exit orifice is $A_{noz}$ and wherein:

$$1.3 < \frac{A_{in}}{A_{noz}} < 4.$$

38. A nozzle apparatus as recited in claim 31 wherein each of said Venturi tubes is bent along a converging spiral path and said swirling means includes a swirling plate having skewed passages therethrough aligned with each of said Venturi tube entrance cones for imparting a convergent spiral flow path to liquid passing through said Venturi tubes.

39. A nozzle apparatus as recited in claim 38 wherein said plurality of Venturi tubes are spaced radially from the nozzle axis on concentric circles normal to the nozzle axis.

40. A nozzle apparatus as recited in claim 39 wherein said the radially outermost Venturi tube produces a flow velocity that exceeds the flow velocities from the inner Venturi tubes.

41. A nozzle apparatus as recited in claim 39 additionally comprising a flow control needle displaceable axially with respect to said exit orifice for varying the open area of said exit orifice and the flow rate through said nozzle apparatus.

42. A nozzle apparatus as recited in claim 41 wherein each said Venturi tube exit cone extends along is spiral axis for a distance of between $3d_n$ and $20d_n$.

43. A nozzle apparatus as recited in claim 42 wherein said input means supplies liquid to said Venturi tubes at a velocity and pressure that produces a Reynold's number in excess of 10,000.

44. A nozzle apparatus as recited in claim 28 wherein said housing forms a cylindrical vortex chamber located on the nozzle axis in communication with the exit orifice, wherein each of said Venturi tubes is characterized by a converging spiral flow path that intersects the vortex chamber and wherein said nozzle apparatus additionally includes a skewed passage for directing defining individual flow paths to each Venturi tube entrance cone, each of said skewed passages introducing a velocity and momentum component in a plane normal to the nozzle axis thereby to enable said liquid to flow through said Venturi tubes and said exit orifice before significant cavity collapse occurs.

45. A nozzle apparatus as recited in claim 44 wherein each of said skewed passages communicating with its respective Venturi tube entrance cone has a length along the flow path that is between seven and eleven times the radial opening of said passage thereby to produce a laminar flow into said respective Venturi tube.

46. A nozzle apparatus as recited in claim 44 wherein each of said Venturi tubes wraps about the nozzle axis with a pitch angle of less than 90°.

47. A nozzle apparatus as recited in claim 46 wherein the Venturi axis at the beginning of each of said entrance cones defines an angle with respect to reference axis of less than 90°.

48. A nozzle apparatus as recited in claim 47 wherein $R_y$ represents a twisting arm radius from said nozzle axis to the Venturi axis at the beginning of each of said entrance cones and $R_{noz}$ represents the area of said exit orifice and the ratio of the twisting arm radius and exit orifice area is given by:

$$\frac{R_y}{R_{noz}} \geqq 1.$$

49. A nozzle apparatus as recited in claim 48 wherein the included angle of each said exit cone increases continuously from 0° at said throat to about 6° at said exit port.

50. A nozzle apparatus as recited in claim 48 wherein said input means includes means for introducing liquid to said Venturi tubes with a Reynold's number $>2300$.

51. A nozzle apparatus as recited in claim 13 additionally comprising means for mixing steam into the liquid intermediate said inlet means and said Venturi entrance cones to achieve a concentration of the steam between $10^{-3}$ and $10^{-2}$ fractions of the total liquid mass.

52. A nozzle apparatus as recited in claim 51 wherein said nozzle apparatus includes diffusion chamber means intermediate said inlet means and said Venturi entrance cones and injector means for conveying the steam into said diffusion chamber means.

53. A nozzle apparatus as recited in claim 52 wherein the distance between said injector means and said exit orifice is at least ten times the diameter of said exit orifice.

* * * * *